US007461003B1

(12) United States Patent
Tanrikulu

(10) Patent No.: US 7,461,003 B1
(45) Date of Patent: Dec. 2, 2008

(54) METHODS AND APPARATUS FOR IMPROVING THE QUALITY OF SPEECH SIGNALS

(75) Inventor: Oguz Tanrikulu, Wellesley, MA (US)

(73) Assignee: Tellabs Operations, Inc., Naperville, IL (US)

( * ) Notice: Subject to any disclaimer, the term of this patent is extended or adjusted under 35 U.S.C. 154(b) by 1014 days.

(21) Appl. No.: 10/691,219

(22) Filed: Oct. 22, 2003

(51) Int. Cl.
*G10L 19/00* (2006.01)

(52) U.S. Cl. ..... 704/500

(58) Field of Classification Search ..... 704/500
See application file for complete search history.

(56) References Cited

U.S. PATENT DOCUMENTS

| | | | | |
|---|---|---|---|---|
| 5,581,652 | A * | 12/1996 | Abe et al. | 704/222 |
| 6,680,972 | B1 * | 1/2004 | Liljeryd et al. | 375/240 |
| 6,704,711 | B2 * | 3/2004 | Gustafsson et al. | 704/258 |
| 7,181,402 | B2 * | 2/2007 | Jax et al. | 704/500 |
| 2003/0158726 | A1 * | 8/2003 | Philippe et al. | 704/203 |
| 2003/0187663 | A1 * | 10/2003 | Truman et al. | 704/500 |
| 2003/0233234 | A1 * | 12/2003 | Truman et al. | 704/256 |
| 2003/0233236 | A1 * | 12/2003 | Davidson et al. | 704/258 |

* cited by examiner

*Primary Examiner*—Susan McFadden
(74) *Attorney, Agent, or Firm*—Hamilton, Brook, Smith & Reynolds, P.C.

(57) ABSTRACT

Methods and apparatus to extend the bandwidth of a speech communication to yield a perceived higher quality speech communication for an enhanced user experience. In one aspect of the invention, for example, methods and apparatus can be used to extend the bandwidth of a speech communication beyond a band-limited region defined by the lowest limit and highest limit of the frequency spectrum by which such speech communication is otherwise characterized absent such bandwidth extension. In another aspect of the invention, for example, methods and apparatus can be used to substitute for corrupt, missing or lost components of a given speech communication, or to otherwise enhance the perceived quality of a speech communication, by extending the speech communication to include one or more artificially created points within the region defined by the lowest limit and highest limit of the frequency spectrum by which such speech communication is characterized. The result is a speech communication that is perceived to be of higher quality. The various aspects of the present invention can be applied, for example, to network devices or to end-terminal devices.

25 Claims, 14 Drawing Sheets

METHODS AND APPARATUS FOR IMPROVING THE QUALITY OF SPEECH SIGNALS

BACKGROUND OF THE INVENTION

Human speech has frequencies up to 20 KHz, but current analog and digital communications systems that carry telephone traffic or devices that can store and playback speech typically support only band-limited speech signals. In the case of telephony, the supported speech bandwidth, known as the voice-band, is from 300 Hz to 3.4 KHz. The limited support of the voice spectrum causes a loss of quality of speech in a number of ways. Unvoiced sounds such as /s/ and /f/ have energies mostly above 4 KHz and therefore are highly attenuated. This leads to a significant loss of intelligibility, since unvoiced sounds are central to highly intelligible speech. The loss of intelligibility is even more pronounced if the listening environment itself is noisy. Speech signals that are limited to 4 KHz are often perceived as muffled and monotonous. Narrowband voice coders that are widely used in wireless networks such as CELP (Code Excited Linear Prediction) and its derivatives cause further loss of brightness due to the noisy excitation signals kept in codebooks. The limited support of the voice spectrum causes a loss of quality of speech in a number of ways.

In the area of speech coding, many advances have been made to the compress and decompress human speech because of the high degree of redundancy in a speech signal. The majority of the speech converters (such as, for example decoders and encoders) developed to date (such as the ITU G. series) are designed to operate on 8 KHz sampled digital speech signals, implying a 4 KHz bandwidth. Some wideband coders, such as G.722, operate on 16 KHz sampled digital signals, where the bandwidth is 8 KHz wide.

The quality difference between 8 KHz bandwidth, referred to here as wideband, and the 4 KHz bandwidth speech, referred to here as narrowband, is significant. A wideband speech communication typically is of higher quality than a narrowband speech communication, as a result of the increased bandwidth of the wideband communication. Similarly, a broadband speech communication typically is of higher quality than a wideband speech communication. Such a quality difference between narrowband speech signals, on one hand, and either wideband or broadband speech signals, on the other hand, becomes significant in circumstances where, for example, a communications device that is capable of communicating a higher-quality wider bandwidth speech communication receives as an input a lower-quality narrower bandwidth speech communication. Such narrower bandwidth speech communication may be band limited as a result of upstream voice coders or other band-limiting influences. Ordinarily in circumstances of this sort, when a wider bandwidth device receives as an input only a narrower bandwidth speech communication, the higher quality speech communication capabilities of the wider bandwidth device are not utilized. The inventor of the present invention has recognized the opportunities presented by this underutilization of wider bandwidth device capabilities.

Various methods have been described in the past in an effort to help address the issue of quality disparity between narrower bandwidth speech communications and wider bandwidth devices. These methods include, for instance, linear predictive coding (LPC), auto-regressive modeling, spectral analysis, and Gaussian Mixture Model (GMM) modeling. These methodologies, however, each have one or more shortcomings or other drawbacks, and certain of the shortcomings or drawbacks may be common to more than one methodology. Examples of such shortcomings or other drawbacks include, without limitation: the methodology introduces objectionable artifacts into the signal; the methodology in the past has failed to adequately account for noise that is present in the communication in combination with the desired speech; the methodology, at least if it is a statistical methodology, may require training on a corpus of speech vectors leading to statistical models with language dependency problems; the methodology makes use of highly complex algorithmic solutions which, because of associated increased power requirements, are not well-suited for battery-powered devices such as a cellular handset; and/or the methodology uses large codebooks and feature vectors (such as, for example, those that may be extracted from a narrowband speech signal), thereby requiring significant memory utilization. As a result, the communications industry still lacks a compelling solution.

Furthermore, quality issues related to speech communications are not confined to the afore-mentioned distinction between the amount of bandwidth that narrower bandwidth speech communications support as compared to the higher bandwidth capabilities of wider bandwidth devices. In other words, aside from whether there is any increased bandwidth opportunity for a given bandwidth-limited speech signal, a speech communication of a given bandwidth can be or become degraded or otherwise lacking in quality. Indeed, one or more components of the supported speech communication frequency spectrum of a given speech communication may be, for example, missing, degraded or otherwise subject to unwanted artifacts. Such a condition is not necessarily limited to narrowband speech communications, but rather might also be found to occur in wideband or even broadband speech communications. The result may be a speech communication of diminished quality as compared against the quality potential that the bandwidth of the given speech communication is otherwise capable of supporting.

SUMMARY OF THE INVENTION

In one aspect of the present invention, methods and apparatus of the present invention can be employed to extend the bandwidth of a speech communication beyond a band-limited region to which the speech communication may be otherwise constrained. Such techniques can be used to provide higher fidelity speech to the listener for an enhanced user experience. In another aspect, methods and apparatus of the present invention can be applied to improve speech communications that are degraded or otherwise lacking in quality. The result is a perceived higher quality speech communication for an enhanced user experience.

The various aspects of the present invention can be applied, for example, to equipment that is a part of a communications network or to end-user equipment that is used to communicate speech through a communications network. Unlike prior technologies, bandwidth extension processing techniques of present invention need not necessarily be decomposed as the extension of the short-time spectral envelope and the excitation error signal. Moreover, the methods and apparatus described herein do not necessarily require an analysis technique to extract the short-term spectral envelope of speech signals known as linear predictive coding or auto-regressive modeling or spectral analysis. Furthermore, a priori training of a statistical model is not necessarily required, in contrast to at least certain prior methodologies.

Other features and advantages will become apparent from the following detailed description, drawings, and claims.

DETAILED DESCRIPTION

Figure 1:
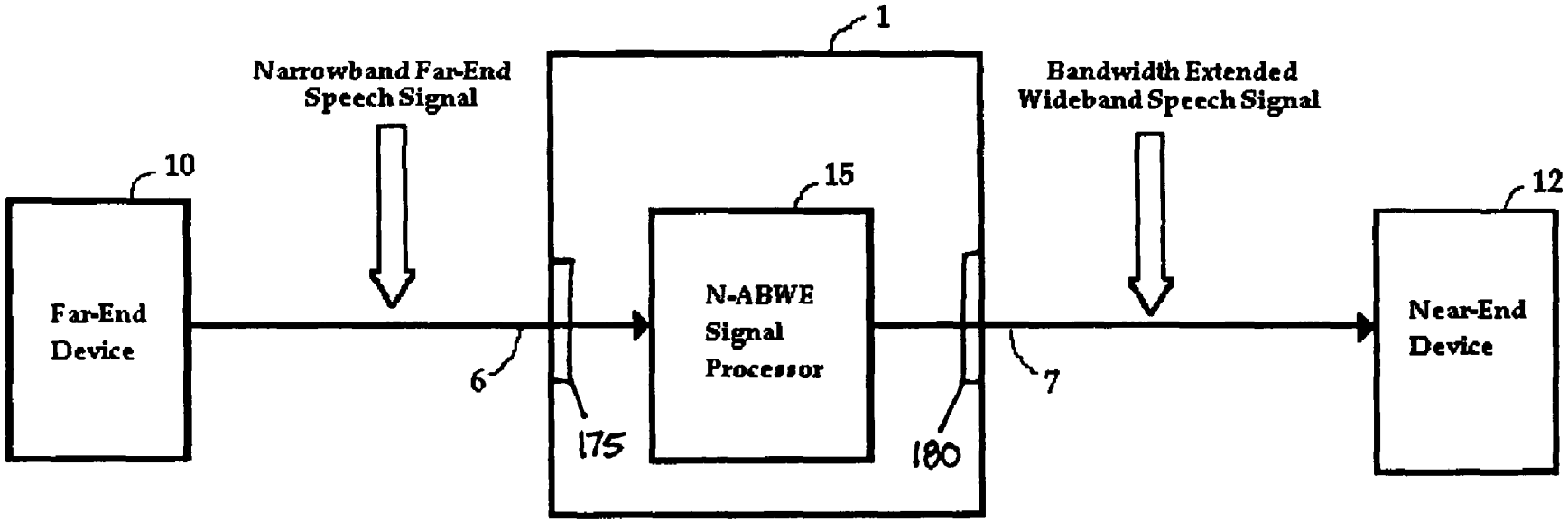
FIG. 1 is a block diagram of an example embodiment in which a network device is used to provide bandwidth extension for a signal representing speech communications.

In one aspect of the present invention, methods and apparatus of the present invention can be employed to extend the bandwidth (e.g., the frequency spectrum) of a speech communication beyond a band-limited region to which the speech communication may have been constrained due to equipment limitations or otherwise. In other words, bandwidth extension techniques of the present invention make it possible to extend the speech communication to include one or more artificially created points outside the region defined by the lowest limit and highest limit of the frequency spectrum by which such speech communication is otherwise characterized. For convenience, this aspect of the present invention may be referred to herein simply as bandwidth extension for spectral expansion. Such techniques can be used to provide higher fidelity speech to the listener for an enhanced user experience.

In another aspect, methods and apparatus of the present invention can be applied to improve speech communications that are degraded or otherwise lacking in quality. Indeed, bandwidth extension techniques of the present invention make it possible to artificially substitute for missing or lost components of a given speech communication, or to otherwise enhance the perceived quality of a speech communication, by extending the speech communication to include one or more artificially created points within the region defined by the lowest limit and highest limit of the frequency spectrum by which such speech communication is characterized. For convenience, this aspect of the present invention may be referred to herein simply as bandwidth extension for spectral enhancement. The result is a perceived higher quality speech communication for an enhanced user experience.

Example embodiments of the present invention are described below. Certain of the embodiments described and illustrated herein represent network devices having artificial bandwidth extension technology that is within the scope of the present invention. Certain other of the embodiments described and illustrated herein represent end-terminal devices having artificial bandwidth extension technology that is within the scope of the present invention.

The term "network device", as used herein, describes generally a device that is adapted to be deployed in a communication network. Those of ordinary skill in the art understand that the term network devices, in general, defines a relatively broad category of communications equipment. Communications equipment of various different types and forms can each be commonly categorized as network devices. For instance, those of ordinary skill in the art will understand that one example network device may be designed or otherwise suited to be deployed at or near the edge of the network, while another example network device may be designed or otherwise suited to be deployed more centrally within the network.

Network devices, however, do not include end-terminal devices.

The term "end-terminal device", as used herein, describes generally an end-user device that is used by an end-user who is communicating through a communications network, and those of ordinary skill in the art will understand a device that is herein described as an end-terminal device can, in practice, take any one of a number of various forms. The term end-terminal device, however, does not include any device that is a network device. End-terminal devices typically have a transducer (such as a speaker) and are purchased by, or at least directly configured and controlled by, end-users who desire to communicate over a communication network. Thus, example end-terminal devices may include, without limitation: telephone handsets (such as land-line, circuit-switched, Internet Protocol a.k.a. "IP", cordless, or wireless cellular or satellite telephones, for example) or base units; headsets and hands-free communication devices; personal digital assistants (PDAs); audio devices with record and playback (such as telephone answering machines, for example); audio/video devices with record and playback; video games; end-user computers (such as desk top, lap top, hand-held or other portable computers); public address systems; user-based teleconferencing systems; etc.

In contrast, network devices are not end-terminal devices. Network devices do not have a transducer. Moreover, network devices typically are not purchased by, or directly configured and controlled by, end-users who desire to communicate over a communication network, but rather are acquired and deployed by an operator of a communication network that carries end-user communication traffic. Example network devices may include, without limitation: single- or plural-channel network access devices without a transducer; gateways; switches; hubs; routers; mail transport agents; conferencing bridges; Multimedia Terminal Adapters (MTAs) that provide, for example, high bandwidth audio connection to customer(s) and Public Switched Telephone Network (PSTN) bandwidth upstream; media gateway/servers that, for example, service narrowband coding on one side and broadband coding on the other side; Business-to-Business Internet Protocol (BBIP) egress nodes that service customer(s) with high bandwidth phones (e.g., IP phones); Voice Quality Enhancement (VQE) gear at intersection of narrowband and broadband coding; Automatic Speech Recognition (ASR) and/or multimedia messaging systems (e.g., voicemail) with, for example, broadband playback capability; networking hubs with broadband capacity to satellite I/O devices (connected either wirelessly or wired); streaming media support in the network across a coding protocol boundary; multi-service Provisioning Platforms (MSPP) that, for example, can be deployed at a coding protocol boundary; etc.

FIG. 1 illustrates one example network device embodiment and application of the present invention. Network device 1 receives as an input signal 6, through interface 175, a narrowband far-end speech communication that originated at far-end device 10. Far-end device 10 may code the communication in such a way so as to limit the bandwidth of the communication, such as to a bandwidth of 4 KHz for example. Far-end device 10 may, for instance, employ a coding scheme in accordance with the International Telecommunications Union ITU-T G.729 standard. Near-end device 12, however, may be configured to receive as an input, and convert (e.g., decode) if necessary, speech having a wider bandwidth than the narrowband communication transmitted by far-end device 10. Near-end device 12 may, for example, employ a decoding scheme in accordance with the ITU-T G.722 standard. Accordingly, network device 1 artificially extends the bandwidth of a signal 6 carrying or otherwise comprising narrowband speech that is received as an input by network device 1. The bandwidth extended signal 7 is provided by network device 1 through output interface 180. Downstream, at near-end device 12, bandwidth extended signal 7 is received as an input and, after any applicable standard audio processing (not shown) commonly known to those skilled in the art, delivered to a transducer. As a result, there can be an improvement as to the perceived quality of the signal received as an input by a near-end device 12 that is capable of communicating speech having a wider bandwidth than the narrowband communication transmitted by far-end device 10.

Figure 2:
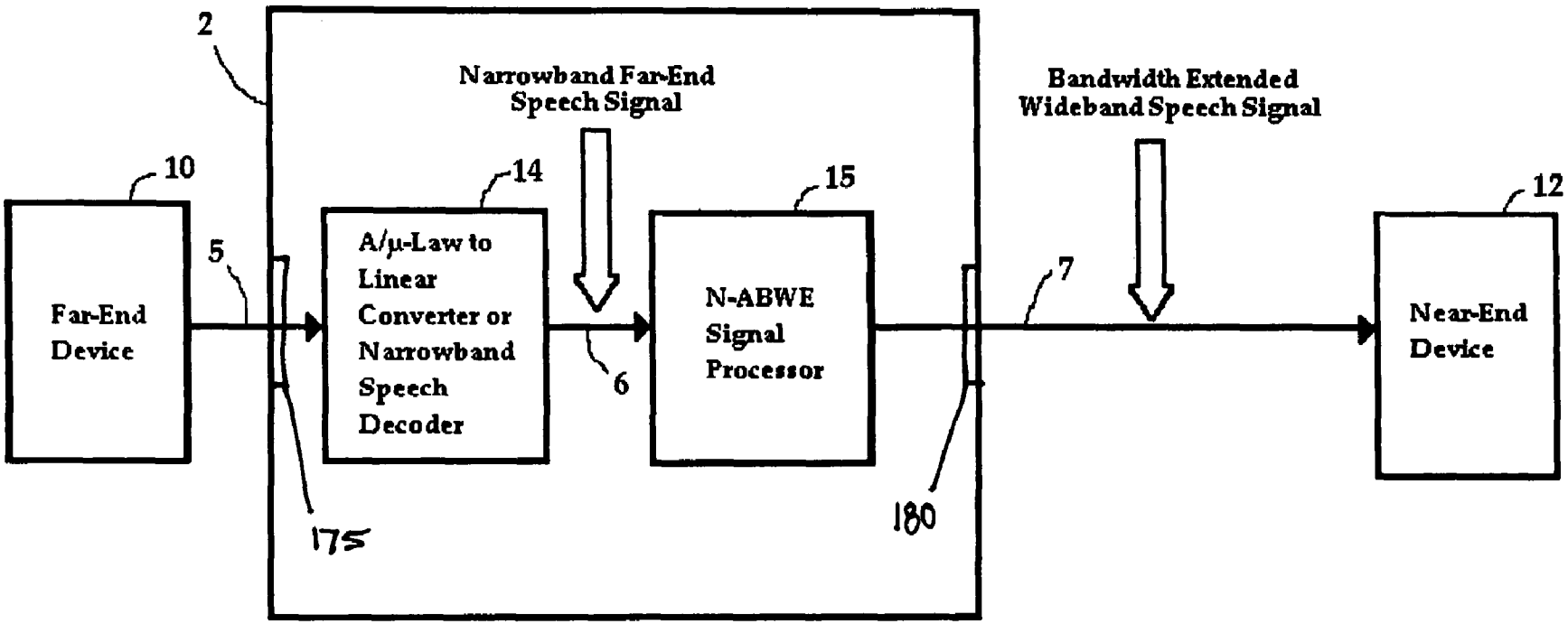
FIG. 2 is a block diagram of an example embodiment in which a network device is used to provide bandwidth extension for a signal representing speech communications, wherein the network device converts (e.g., decodes) the speech signal prior to bandwidth extension processing.
Figure 3:
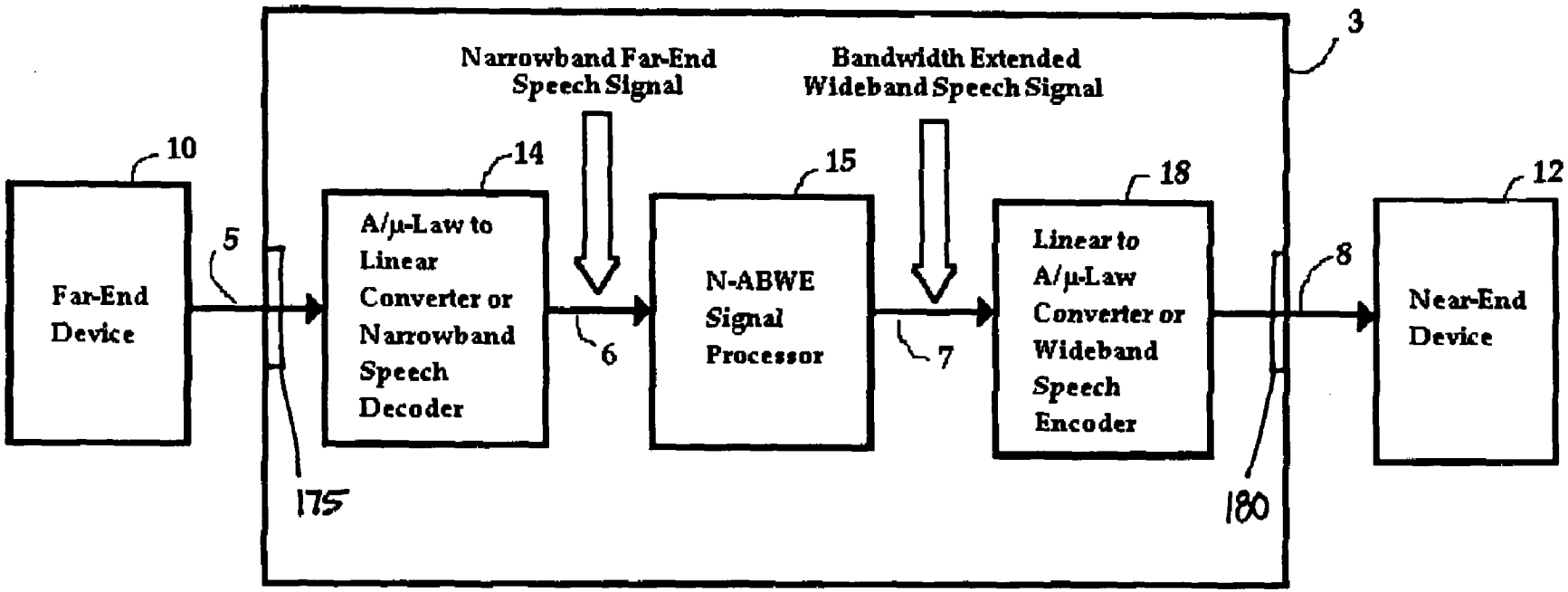
FIG. 3 is a block diagram of an example embodiment in which a network device is used to provide bandwidth extension for a signal representing speech communications, wherein the network device converts (e.g., decodes) the speech signal prior to bandwidth extension processing and converts (e.g., encodes) the speech signal following bandwidth extension processing.

FIGS. 2 and 3 illustrate alternative example embodiments and applications of the present invention, wherein network devices 2 (FIG. 2) and 3 (FIG. 3) similarly are used in a communications network, intermediate of far-end device 10 and near-end device 12, to artificially extend the bandwidth of a narrowband speech signal. In FIG. 3, network device 3 is shown to comprise signal processor 15, as well as converter (e.g., decoder) 14 and converter (e.g., encoder) 18. In the example embodiment of FIG. 3, the signal processor 15 bears the label that reads "N-ABWE," which means simply that the signal processor 15 is deployed so as to carry out a method of processing speech communications in a network device environment (N-) to provide artificial bandwidth extension (ABWE) within the scope of the present invention. In this example embodiment, firmware or other software may supply instructions executed by signal processor 15 in accordance with the present invention, for example. The "N-ABWE" label also appears in other of the figures, and has the same meaning with respect to such other figures.

In operation, a converted (e.g., decoded) signal is generated by a speech converter 14 that converts (e.g., decodes) to a linear format a coded narrowband speech signal 5 transmitted by an upstream far end device 10 and received through network device input interface 175. Network device input interface 175 could be a wired (e.g., electrical or optical conductor, etc.) or wireless (e.g., radio frequency, etc.) interface, for example. The coding scheme for purposes of this example embodiment can be one of the well-known A-law or μ-law formats, for instance, or a more sophisticated or otherwise different speech coding operation. The converted signal 6 is delivered to the signal processor 15 for bandwidth extension processing. A bandwidth extended communication signal 7 provided by signal processor 15 is in turn delivered to speech converter (e.g., encoder) 18, which generates a converted (e.g., encoded) signal by converting (e.g., encoding) the bandwidth extended signal from a linear format to another format, such as for example back to the A-law or μ-law format. The converted bandwidth extended communication signal 8 is in turn delivered external to the network device 3 through network device output interface 180, where it is received downstream at near-end device 12. Network device output interface 180 could be a wired (e.g., electrical or optical conductor, etc.) or wireless (e.g., radio frequency, infrared, etc.) interface, for example. Near-end device 12 may receive as an input, and convert if necessary, the bandwidth extended communication signal to yield what a near end listener perceives as a higher quality speech communication.

The network device 2 of FIG. 2 is similarly shown to comprise signal processor 15 and converter 14, but by contrast to FIG. 3, network device 2 doesn't necessarily comprise a converter similar to converter 18 of FIG. 3. In the example embodiment and application illustrated by FIG. 2, any such encoding operation may be, for example, performed by other network equipment (not shown) that is positioned downstream of network device 2. The network device 1 of FIG. 1 is similarly shown to comprise signal processor 15, but, by contrast to FIGS. 2 and 3, network device 1 doesn't necessarily comprise converters similar to converter 14 of FIG. 2 or converters 14 and 18 of FIG. 3. In the example embodiment and application illustrated by FIG. 1, any such decoding or encoding operations may be, for example, performed by other network equipment (not shown) upstream or downstream of network device 1, as applicable.

Indeed, certain applications of the present invention may not even require that certain of the afore-mentioned coding operations be performed at the network level, either within the network device or otherwise. For instance, it is possible for a network device to deliver a bandwidth extended communication signal 7 in a linear format to other downstream equipment, such as end-user equipment for example, for further processing, transmission, and/or transduction through the use of a loudspeaker, by such other equipment. Such an arrangement may not include any encoding of the bandwidth extended communication signal 7 at any point intermediate of the signal processor 15 and such other downstream equipment. This can be the case, for example, with respect to an example embodiment in accordance with the present invention wherein the network device comprises a customer premise network device, such as a single-channel customer premise network device for example, and the near-end device is end-user equipment that is capable of receiving as an input the bandwidth extended communication signal 7 in a linear format directly from the customer premise network device. Such a customer premise network device may comprise a converter 14, in accordance with the network device 2 embodiment shown in FIG. 2, or it may not necessarily comprise a converter, in accordance with the network device 1 embodiment shown in FIG. 1.

Figure 4:
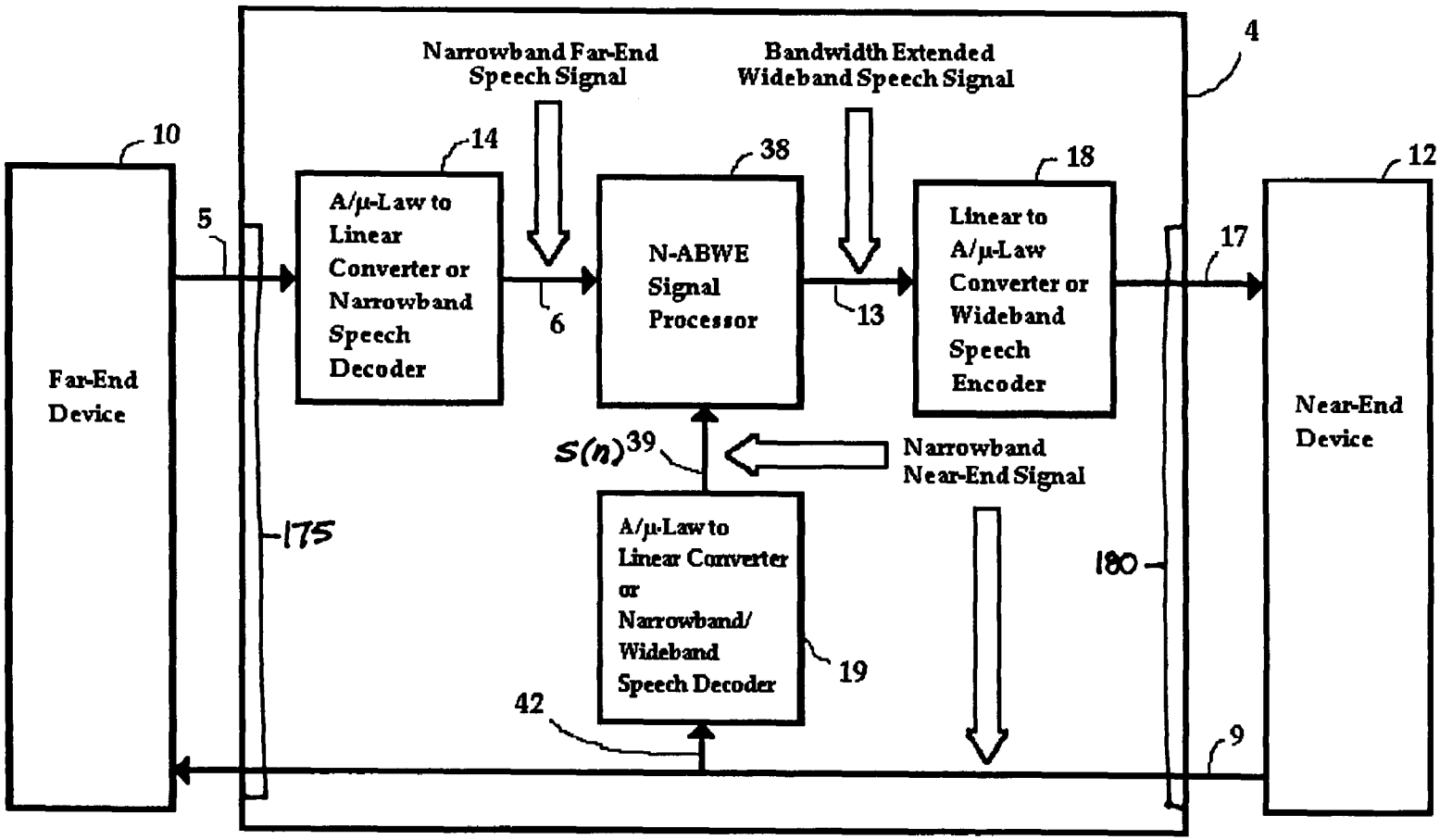
FIG. 4 is a block diagram of another example embodiment in which a network device is used to provide bandwidth extension for a signal representing speech communications, but wherein the network device further is shown to receive as an input and convert a narrowband near-end speech signal for the purpose of using a signal representative of the near-end speech communication (including ambient noise) in generating the bandwidth extended far-end signal provided by the network device.
Figure 13:
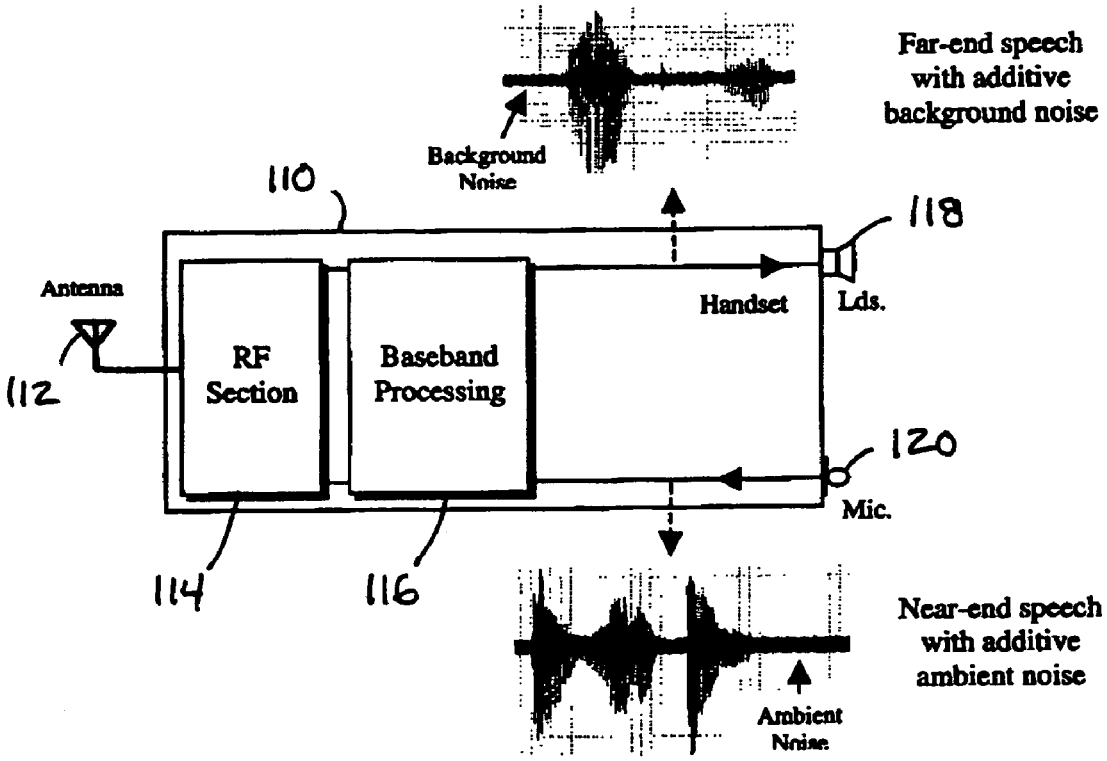
FIG. 13 depicts a generic end-terminal device with representative illustrations to show an additive background noise on far-end speech on the loudspeaker side of the device and additive ambient noise on the near-end speech on the microphone side of the device.

Referring now to the alternative example network device embodiment and application of the present invention illustrated by FIG. 4, bandwidth extension signal processing can further make use of detected ambient noise at the near-end in formulating the bandwidth extended communication signal 13. While background noise is defined herein as the noise that is present as an additive component on the far-end (speaking) speech signal, ambient noise is defined herein as the acoustical noise that is present in the near-end (listening) environment. Examples of each of these types of noise signals are illustrated in connection with the embodiment shown in FIG. 13.

Both noise signals make the intelligibility of speech from the far-end speaker more difficult to hear for the near-end listener. The near-end ambient noise reduces intelligibility since it is in the listening environment, especially in a shopping mall, restaurant, or train station, for example. The background noise on the far-end speech also reduces intelligibility because components of speech may be masked by noise.

Referring back again to FIG. 4, ambient noise at the near-end can be used by signal processor 38 in order to select an appropriate level for the bandwidth extension portion of the signal spectrum, so as to help counterbalance the adverse affects of ambient noise. In the figure, the far-end speech communication represented by far-end signal 5 and the near-end speech communication represented by near-end signal 9 together form a duplex speech communication. Accordingly, if the near-end signal 9 (including at least any associated ambient noise) is indeed available to network device 4, such near-end signal 9 can be referenced by the signal processor 38 for the purpose of counterbalancing the adverse affects of ambient noise. Specifically, while in this embodiment the near-end signal 9 is communicated past network device 4 to downstream far-end device 10, signal processor 38 also references the near-end signal 9 through tap signal 42, converter (e.g., decoder) 19 and converted (e.g., decoded) signal 39. More particularly, converter 19 converts (e.g., decodes) the near-end signal 9 to provide a converted near-end signal 39 to the signal processor 38, which such signal processor 38 in turn uses this near-end signal reference, as explained in greater detail below, to provide a bandwidth extended communication signal 13.

Figure 5:
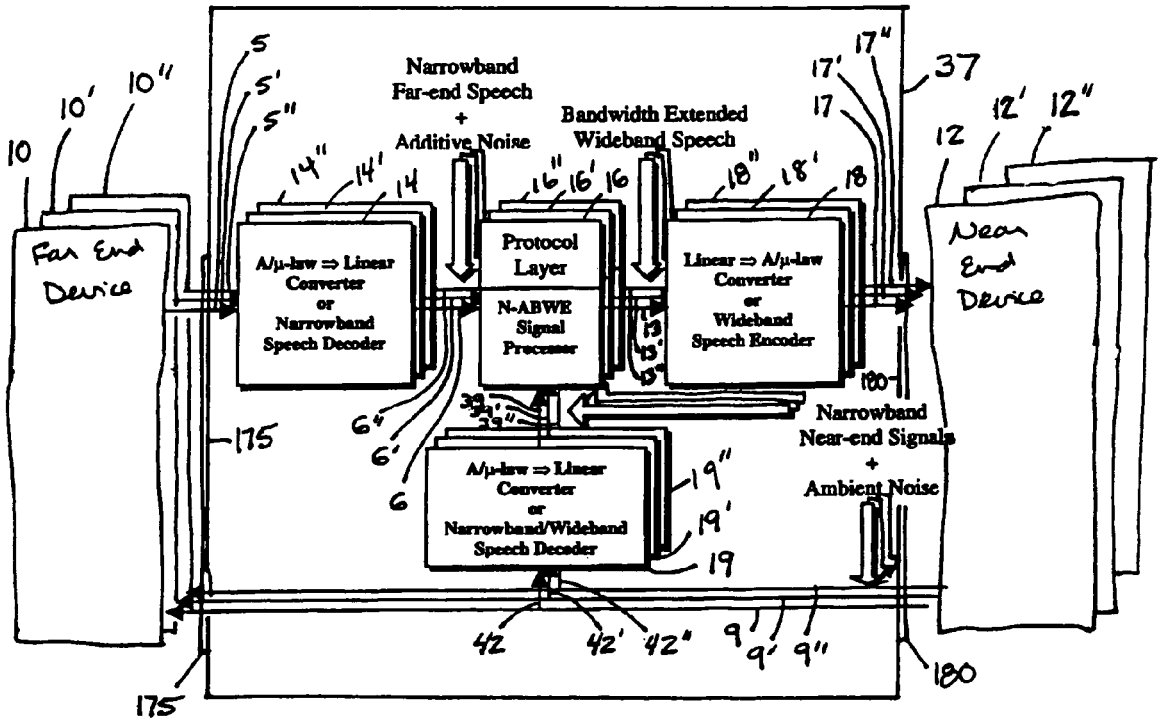
FIG. 5 is a block diagram of an example embodiment in which a network device is used to provide bandwidth extension for one or more signals representing plural speech communications.

The alternative example network device embodiment and application illustrated in FIG. 5 comprises a network device 37 that operates similar to the network device 4 described above. Network device 37 differs insofar as it is specifically shown to be capable of providing bandwidth extension processing on more than one channel of speech communication. In this way, network device 37 is a considered a multi-channel network device. Moreover, example network device 37 is specifically shown to be further capable of providing protocol negotiations to enable a network connection to which bandwidth extension is applied. In this case, signal processor 16 is at a protocol boundary that negotiates the bandwidth of the communication signal to which bandwidth extension is applied, and network device 37 thus affects the mode of communication for a communication that is negotiated through the protocol layer.

In FIG. 5, a first of the plural narrowband far-end speech channel signals to which bandwidth extension processing can be applied using network device 37 is shown using reference numerals 5 and 6. Once bandwidth extension processing of signal processor 16 is applied to such first narrowband channel signal represented by reference numerals 5 and 6, the channel signal becomes bandwidth extended channel signal represented in FIG. 5 by reference numerals 13 and 17. Corresponding near-end channel signal 9 is the signal that can be referenced by signal processor 16, through tap signal 42, converter 19 and converted signal 39, in the generation of bandwidth extended channel signal 13.

Since network device 37 is a multi-channel device, a second of the plural narrowband far-end speech channel signals to which bandwidth extension processing can be applied using network device 37 is shown using reference numerals 5' and 6'. Once bandwidth extension processing of signal processor 16' is applied to such second narrowband channel signal represented by reference numerals 5' and 6', the channel signal becomes bandwidth extended channel signal represented in FIG. 5 by reference numerals 13' and 17'. Corresponding near-end channel signal 9' is the signal that can be referenced by signal processor 16', through tap signal 42', converter 19' and converted signal 39', in the generation of bandwidth extended channel signal 13'. Similarly, a third of the plural narrowband far-end speech channel signals to which bandwidth extension processing can be applied using network device 37 is shown using reference numerals 5" and 6". Once bandwidth extension processing of signal processor 16" is applied to such first narrowband channel signal represented by reference numerals 5" and 6", the channel signal becomes bandwidth extended channel signal represented in FIG. 5 by reference numerals 13" and 17". Corresponding near-end channel signal 9" is the signal that can be referenced by signal processor 16", through tap signal 42", converter 19" and converted signal 39", in the generation of bandwidth extended channel signal 13".

It will be apparent to those skilled in the art that a given multi-channel network device alternatively may process only two channels, or more than three channels, without departing from the scope and spirit of the present invention. It will also be apparent to those skilled in the art that converters 14, 14' and 14" represented schematically in FIG. 5 need not necessarily comprise plural individual channel converters. Indeed, converters 14, 14' and 14" illustrated in FIG. 5 can, for example, together represent a multi-channel unit. The same holds true for converters 19, 19' and 19", as well as coders 18, 18' and 18" and signal processors 16, 16' and 16".

It will also be apparent to those skilled in the art that narrowband far-end speech channel signals 5, 5' and 5" may be delivered to network device 17, and that channel signals 17, 17' and 17" may be transmitted from network device 37, using one or more forms of various media, such as for example via copper wire, coaxial cable, optical fiber or radio frequency. Similarly, the various speech channel signals that traverse between and among the signal processor 16 and the various converters 14, 18 and 19 depicted within the network device 37 illustrated in FIG. 5 can be transmitted between such processing blocks using one or more forms of such various media. The same is true with respect to the speech signals described and illustrated in connection with each of the other alternative network device embodiments of the present invention described herein.

Furthermore, two or more of speech channel signals 5, 5' and 5" may be multiplexed together for transmission to the network device, and/or two or more of speech channel signals 17, 17' and 17" may be multiplexed together for transmission from the network device. In addition, two or more of near-end speech channel signals 9, 9' and 9", and/or tap signals 42, 42' and 42", may be multiplexed together for transmission purposes. Similarly, the various speech channel signals that traverse between and among the signal processor 16 and the various converters 14, 18 and 19 depicted within the network device 37 illustrated in FIG. 5 can be multiplexed together for transmission purposes between two or more of such processing blocks.

With respect to the above-described FIGS. 1-5, it will be understood by those skilled in the art that the illustrations in each of the figures are not intended to imply that various applications of the present invention in a communication network environment necessarily would not have any other devices or components intermediate of the far-end device 10 and the near-end device 12, aside from network devices 1 (FIG. 1), 2 (FIG. 2.), 3 (FIG. 3), 4 (FIG. 4) or 37 (FIG. 5). The inventor of the present invention contemplates that various applications of the present invention indeed are likely to have additional intervening devices or components not represented in the figures. In this regard, FIGS. 1-14 herein are intended to be only illustrative of the present invention, rather than limiting in any respect.

Figure 6:
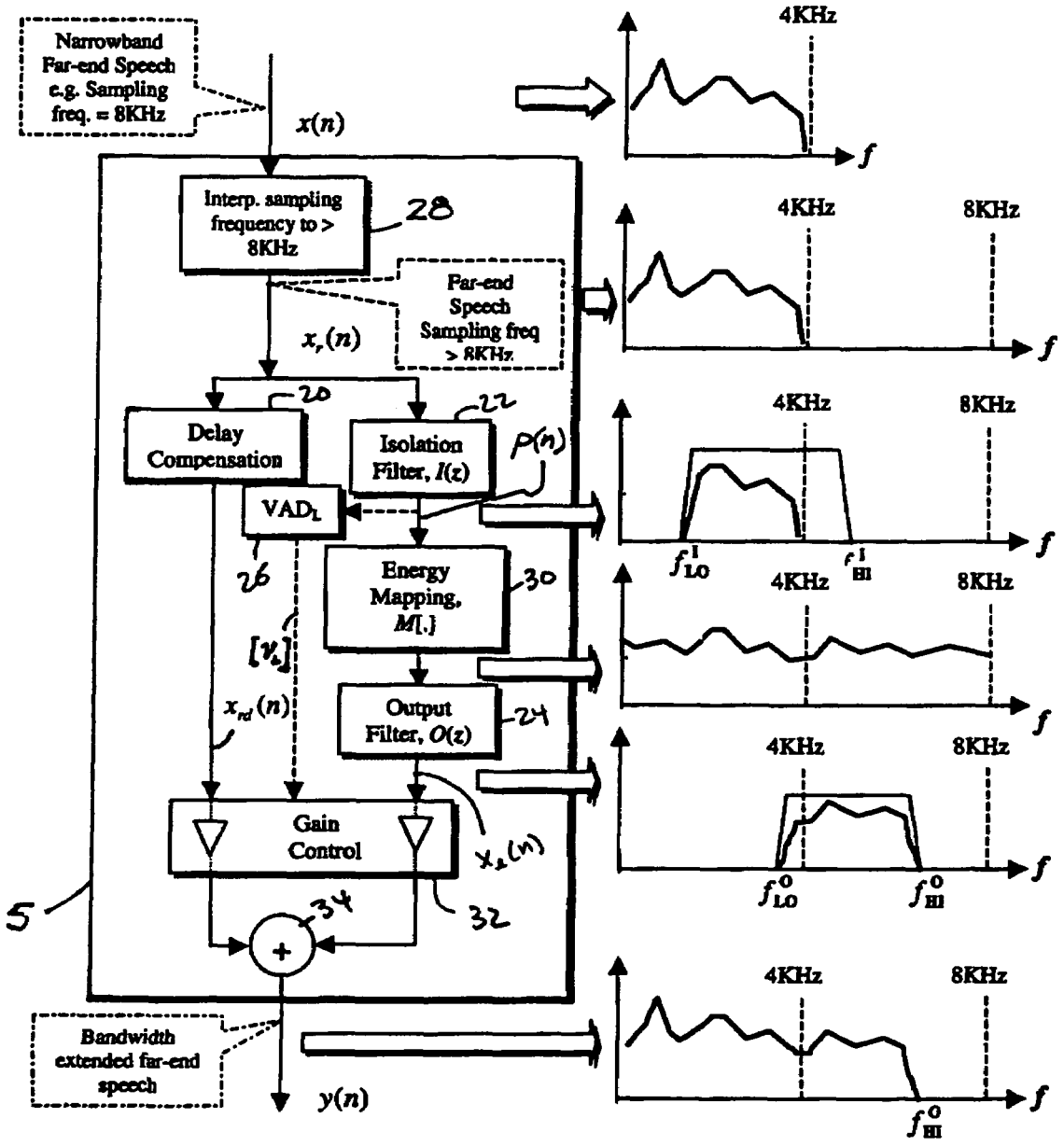
FIG. 6 is a more detailed block diagram and associated waveforms of an example network device signal processor embodiment for performing bandwidth extension.

Referring now to the example embodiment method and apparatus represented schematically by the block diagram shown in FIG. 6, a far-end speech communication signal, x(n), is received as an input for processing. This speech communication signal, x(n), may be, for example, a 4 KHz bandwidth narrowband far-end speech communications signal. The speech communication signal, x(n), is sampled at block 28 at an increased frequency, $f_r$, thus yielding sampled signal $x_r(n)$, which is a sampled version of the far-end speech communication signal after the sampling frequency is increased to $f_r$. Sampling can be an up-sampling using an interpolation mechanism. In the particular example illustrated in FIG. 6, sampling frequency $f_r$>8 KHz is selected for use with an input speech communications signal that is 4 KHz in bandwidth. The sampled signal, $x_r(n)$, is in turn delivered in parallel to both a delay element, such as compensator 20, and an isolation filter 22.

The signal, $x_r(n)$, that is provided to isolation filter 22 is likely to have peaks, known as formants, which at higher frequency portions of the signal are typically of wider bandwidth and lower power than the sharper and higher-power formants in the lower frequency portions of the signal. Moreover, it has been observed that formants that are more adjacent to one another in the frequency spectrum are more likely to exhibit a higher degree similarity, or dependency, to one another as compared to formants that are further separated from each other on the frequency spectrum.

Isolation filter 22 selects a portion of the $x_r(n)$ signal that lies within a given frequency spectrum range, such as for example the range defined by end points $f_{Lo}^I$ and $f_{HI}^I$, as is illustrated in FIG. 6. In the example described above, the frequency range of the band for the isolation filter 22 preferably has a higher frequency limit, $f_{HI}^I$, that is preferably above 4 KHz, so as to ensure that all the signal components as high as 4 KHz are included within the band. The frequency range of the band for the isolation filter 22 has, in this example, a lower frequency limit, $f_{LO}^I$, that is above 1 KHz, and preferably is about 1.5 KHz. Again, in this example, careful selection of the lower frequency limit, $f_{LO}^I$, is preferably intended to avoid passing the higher-power low-frequency formants. Moreover, because of the above-mentioned observation that adjacent speech formants are more likely to exhibit a higher degree similarity or dependency, selection of the lower frequency limit, $f_{LO}^I$, is also preferably intended to focus bandwidth extension resources on those higher-frequency portion (s) of the frequency spectrum of $x_r(n)$ (i.e., a frequency band of $x_r(n)$ that lies adjacent the target bandwidth extension region between 4 KHz and 8 KHz) that are expected to yield a truer, higher-quality bandwidth extended speech communication. In this way, the entire available signal below 4 KHz is preferably not used, but instead only a higher frequency portion of $x_r(n)$ is selected by the isolation filter 22. The isolation filtered signal output by the isolation filter 22 is p(n).

The output of the isolation filter 22, p(n), is next applied to an energy mapping function, denoted in FIG. 6 by M[.] at block 30. Energy mapping block 30 is used to create new frequency spectrum components for the speech signal. More specifically, in this example embodiment, energy mapper or energy mapping block 30 is a memory-less non-linear processor that operates to spread the energy of the isolation filter 22 output, p(n), onto the rest of the spectrum as shown in FIG. 6. This step or function of spreading energy is referred to herein as energy mapping. Such energy mapping can be accomplished in a number of alternative ways. A few representative examples include:

Using a full-wave rectifier, for example:

$$M[p(n)]=|p(n)|^q, q\geqq 1 \tag{1}$$

Using a half-wave rectifier, for example:

$$M[p(n)] = \begin{cases} |p(n)|^q & \pm p(n) \geq o,\ q \geq 1 \\ o & \mp p(n) > o \end{cases} \tag{2}$$

Using modulation, for example:

$$M[p(n)] = p(n)\cos\left(2\pi\frac{f_m}{f_r}n + \rho\right) \tag{3}$$

where $f_m$ is the frequency shift and $\rho\epsilon[-\pi,\pi]$ is an arbitrary angle.

The energy mapper or energy mapping block 30 is preferably designed such that the nonlinear nature of this function preserves and spreads spectrally the harmonic structure of the speech that is captured in the isolation filter 22 bandwidth. As indicated by the illustrations in FIG. 6, the energy mapping block 30 operates to spread the energy across a range of frequencies, including frequencies not meaningfully, if at all, present in the isolation filtered signal. For purposes of the above example, energy mapping block 30 operates to provide an energy mapped output signal having frequency components that range from 0 KHz to 8 KHz.

The output signal of the energy mapper 30 is delivered to output filter 24. As mentioned above, the output signal of the energy mapper 30 includes components at frequencies that are not present in any meaningful way in the isolation filtered signal. In this regard, the output signal of the energy mapper 30 is an expanded version of the isolation filtered signal. Moreover, in this example bandwidth extension for spectral expansion embodiment, output signal of the energy mapper 30 includes components at frequencies that are beyond the bandwidth of the received speech communication signal. In other words, the output signal of the energy mapper 30 has at least one component at a frequency that is outside both the band-limited region associated with the isolation filtered signal and the bandwidth of the received speech communication signal, even though such component of the output signal is derived from at least one characteristic of the isolation filtered signal (and, thus, similarly at least one characteristic of the received speech communication signal). In this way, the output signal of the energy mapper 30 can be viewed more generally as a derivative signal having a derivative relationship to the received speech communication signal.

Output filter 24, in turn, filters output from the energy mapper 30 and, more specifically, operates to pass (i.e., select) that portion of the energy mapper 30 output which lies within a given frequency spectrum range, such as for example the range defined by end points $f_{LO}^{O}$ and $f_{HI}^{O}$, as is illustrated in FIG. 6. In the example described above, the frequency range of the output filter 24 pass band preferably has a higher frequency limit, $f_{HI}^{O}$, which preferably is between 4 KHz and 8 KHz. The lower frequency limit, $f_{LO}^{O}$, in this example, preferably is a little below 4 KHz. The filtered output signal generated by the output filter 24, namely extension signal $x_e(n)$, is the extension portion of the speech communication. This filtered signal representing the extension portion of the speech communication is, in turn, delivered to gain control block 32 where the gain of or for the extension portion of the speech communication can be adjusted, set or otherwise determined, if appropriate. Thereafter, the signal representing the extension portion of the speech communication is combined with a signal representing the speech communication in its non-extended form, as described in greater detail below.

I(z) and O(z) are, respectively, Z-transforms of an isolation filter 22 and an output filter 24 respectively. These band-pass filters 22 and 24 have the following spectral properties:

$$I(e^{j\theta}) = \begin{cases} \delta_{LO}^{I}, & o < \theta \le f_{LO}^{I} \\ 1, & f_{LO}^{I} < \theta \le f_{HI}^{I} \\ \delta_{HI}^{I}, & f_{HI}^{I} < \theta \le \pi \end{cases} \tag{4}$$

$$O(e^{j\theta}) = \begin{cases} \delta_{LO}^{O}, & o < \theta \le f_{LO}^{O} \\ 1, & f_{LO}^{O} < \theta \le f_{HI}^{O} \\ \delta_{HI}^{O}, & f_{HI}^{O} < \theta \le \pi \end{cases} \tag{5}$$

where the δ's correspond to the response in the stop-bands of these filters. The impulse responses of these filters 22 and 24 are i(n) and o(n), respectively, and the linear convolution operation is denoted by *.

As shown in FIG. 6, $x_r(n)$ is also separately provided to delay compensator 20, which is used to introduce a delay so as create as an output delayed speech communication signal, $x_{rd}(n)$. The amount of delay introduced by delay compensator 20 to create delayed signal $x_{rd}(n)$ preferably is selected to match the total amount of any delays that may be separately introduced to $x_e(n)$, relative to $x_r(n)$, as a result of the above-described operation of the isolation filter 22, energy mapper 30 and output filter 24. Considering any appreciable delays that may be introduced by, for example, the isolation filter 22 and/or output filter 24, the delay compensation can be such that:

$$x_{rd}(n) = \begin{cases} x_r(n-d) \\ \text{or} \\ x_r(n) * a(n) \end{cases} \tag{6}$$

where d is the delay or a(n) is an all-pass filter that compensates for the respective phase responses of the isolation filter 22 and output filter 24.

The delayed signal $x_{rd}(n)$, which still represents the speech communication in its non-extended form, is in turn provided to gain control 32, along with the signal representing the extension portion of the speech communication, $x_e(n)$. Gain control 32 sets the power of $x_e(n)$ at an appropriate power level so that $x_e(n)$ is not powered too high or too low relative to $x_{rd}(n)$, but rather properly complements the power level of $x_e(n)$ so as to preferably maximize the perceived quality of the resultant bandwidth extended communication signal. Various alternative techniques can be used to make these power adjustments. One example technique is to spread the power of p(n) over the full spectrum of what will be completed bandwidth extended communication signal, y(n), output from summer or combiner 34. The overall energy of the completed bandwidth extended communication signal can be determined to be substantially the same, if not the same, as the overall energy of the input signal received by the network device. Another example technique is to provide the power at a fixed ratio between $x_{rd}(n)$ and the output of O(z).

A voice activity detector can be used to detect periods of time when there is no speech, such as for example during pauses in conversation, for the purpose of effectively turning off (e.g., muting) the bandwidth extension functionality during those intervals when speech is not detected. As illustrated in FIG. 6, a voice activity detector ($VAD_L$) 26 operates on $p(n)=x_r(n)*i(n)$ and determines the current state of the far-end signal, namely, whether speech is detected on p(n) at a given point in time. The resulting output is:

$$[\upsilon_L] = \begin{cases} 1, & p(n) \text{ is speech} \\ o, & \text{otherwise} \end{cases} \tag{7}$$

Gain control 32 receives the output, $x_L$, from the $VAD_L$ 26 and uses this signal to in effect turn off the bandwidth extension functionality. Gain control 32 accomplishes this by eliminating, or at least significantly reducing, the amount of relative power that is associated with extended signal $x_e(n)$ during those intervals of time when speech is not detected by $VAD_L$ 26. This can be realized by, for example, applying a gain of zero ($g_w$=0) to extended signal $x_e(n)$ during those intervals of time when speech is not detected. An interval of this sort can, for example, commence upon a transition of $v_L$ from a value of one to a value of zero, and can end upon a transition of $v_L$ from a value of zero to a value of one. Gain controller 32 might, for example, apply a gain above zero ($g_w$>0) when $v_L$ has a value of one and apply a gain equal to zero ($g_w$=0) when $v_L$ has a value of zero. Such use of the $VAD_L$ 26 in combination with gain control 32 prevents the network device from delivering bandwidth extended background noise that may be present as a component of the far-end signal, at least during such intervals when speech is not detected. Indeed, it is preferable under such circumstances to avoid extending spectrum that may comprise nothing other than additive background noise.

After processing by gain control 32, both signals $x_{rd}(n)$ and $x_e(n)$ are then, in turn, provided to summer 34, which operates to combine the signals so as to produce as an output a complete bandwidth extended communication signal, y(n). With reference to the example described above and illustrated in FIG. 6, for example, bandwidth extended communication signal y(n) is shown to include not only frequency components between 0 and 4 KHz, but further includes frequency components >4 KHz. In this way bandwidth extended communication signal y(n) is a wider bandwidth speech communication as compared to input speech communication signal x(n), or in other words, bandwidth extended communication signal y(n) represents a wider or higher bandwidth version of speech communication represented by input speech communication signal x(n).

Figure 7:
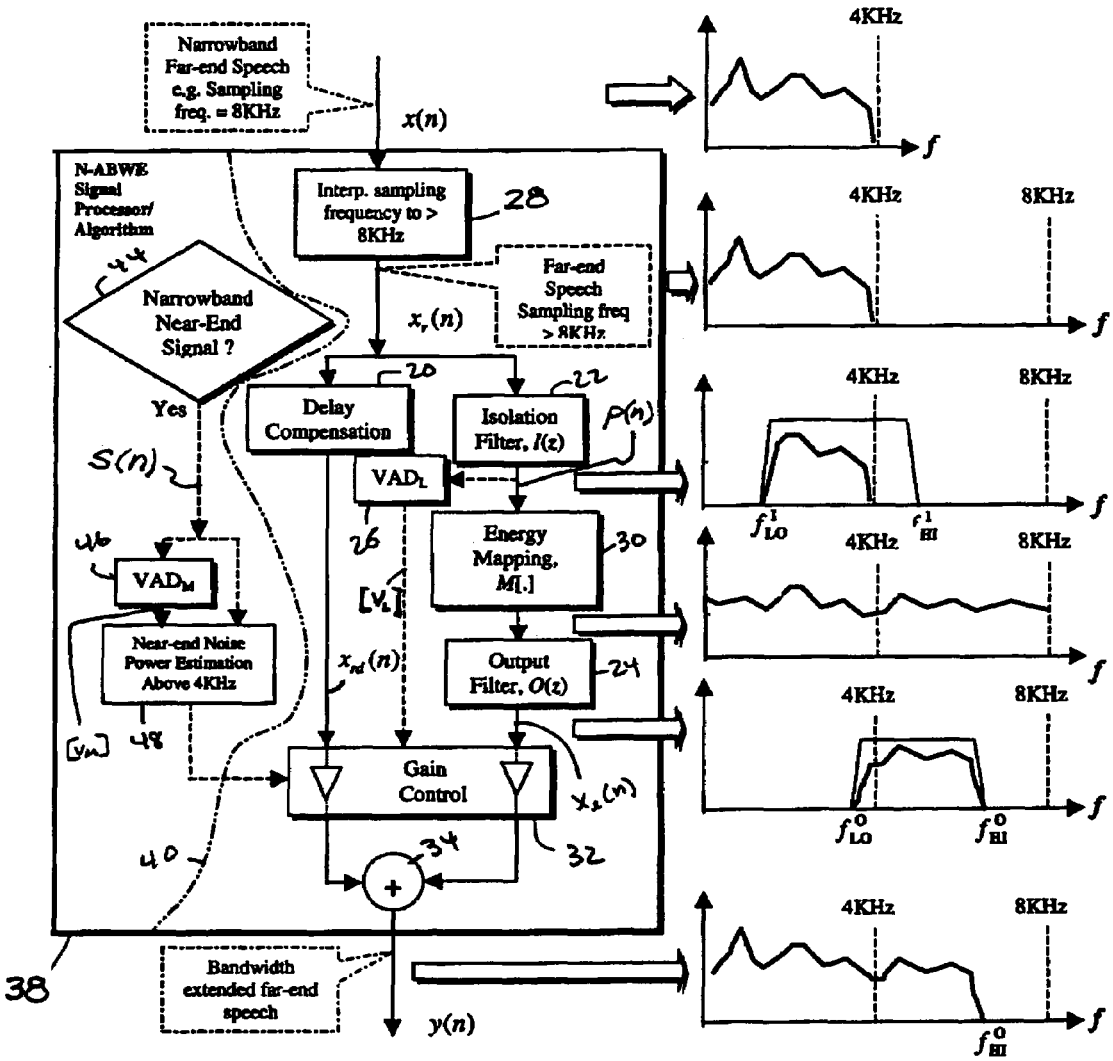
FIG. 7 is a more detailed block diagram and associated waveforms of an example network device signal processor embodiment for performing bandwidth extension, the associated network device having the capability of using a signal representing the near-end speech communication (including ambient noise) in generating the bandwidth extended communication signal.

The signal processing block 38 embodiment illustrated in FIG. 7 operates similarly to that described above in connection with the signal processor 15 schematically illustrated in FIG. 6, except that in FIG. 7, the signal processor 38 has the added capability of referencing near-end signal 9 (via tap signal 42, converter 19 and converted signal 39, as described above in connection with FIG. 4) in generating the bandwidth extended communication signal, y(n). More particularly, the dashed reference curve 40 divides those illustrated processing blocks that principally relate to processing of the far-end signal (for example, reference numerals 20, 22, 24, 26, 28, 30, 32 and 34 in FIG. 7), and those illustrated processing blocks that principally relate to processing of the near-end signal (for example, reference numerals 44, 46, and 48). Thus, the embodiment illustrated in FIG. 7 comprises methods and apparatus that can measure a level of ambient noise at a near-end of the speech communication for use in adjusting, setting or otherwise determining the gain(s) of the bandwidth extended communication signal, y(n). Set forth below are two example alternative cases depending upon whether a near-end signal is indeed available to the signal processing block for processing of a given far-end speech communication.

Now again with reference to FIG. 7, if for example the near-end signal 9 is indeed available (decision block 44) to the signal processor 38, the near-end signal 9 (again, via tap signal 42, converter 19 and converted signal 39) can be input to a voice activity detector ($VAD_M$) 46 for the purpose of determining at any given time whether speech is then present within the near-end signal. The decisions made by this unit are:

$$[v_M] = \begin{cases} 1, & s(n) \text{ is speech} \\ 0, & \text{otherwise (noise)} \end{cases} \tag{8}$$

where s(n) is the near-end signal.

When $[v_M]$=0, an ambient noise power estimate, $\sigma_w^2$, is computed in estimation block 48. This estimate can be based on a sample update such as:

$$\sigma_w^2(n)=\lambda\sigma_w^2(n-1)+(1-\lambda)s^2(n) \tag{9}$$

or by using a block update over a block of R samples as:

$$\sigma_\omega^2(k) = \frac{1}{R}\sum_{j=o}^{R-1} s^2(Rk+j) \tag{10}$$

where k is the block index.

When $[v_M]$=1, speech activity at the near-end is detected, thus making it more difficult to accurately estimate the ambient noise power. As a result, in this example embodiment, the estimate $\sigma_w^2$ in Equation (9) or (10) preferably is not newly determined or updated under such circumstances, but instead a last computed value of $\sigma_w^2$ (e.g., when $[v_M]$ last equaled zero) continues to be used so long as $[v_M]$ continues to equal one. Once $[v_M]$ returns to having a value of zero, and so long as the value of $[v_M]$ continues to equal zero, $\sigma_w^2$ can again be newly determined or updated on a regular periodic basis.

By way of example and illustration, the ambient noise in this particular embodiment is sampled at 8 KHz, and therefore, $\sigma_w^2(.)$ is the power of the ambient noise signal below 4 KHz bandwidth. In order to help maximize the overall intelligibility of the bandwidth extended speech communication, the extension portion(s) of the speech communication must be above the threshold level of the listener's hearing, which is defined by the ambient noise power in this target bandwidth extension spectral region. Although the ambient noise power for this target spectral region is not available in $\sigma_w^2(.)$ an estimate of the noise power in this target spectral region, $\mathfrak{o}_w^2(.)$ can be extrapolated from $\sigma_w^2(.)$ by any number of methods. One example methodology is as follows:

$$\mathfrak{o}_w^2(.)=\sigma_w^2(.)-\text{tdBs}. \tag{11}$$

where t is a constant.

Using various definitions above and the signal flow in FIG. 7, the output of the signal processor 38 can thus be written as:

$$y(n)=g_xX_{rd}(n)+g_wM[x_r(n)*i(n)]*o(n) \tag{12}$$

where $g_x$ and $g_w$ are gain variables. The term $g_x$ is calculated such that the power of the output, y(n), is the same as the narrowband signal, $x_{rd}(n)$. In other words:

$$g_x = \begin{cases} 1 & \text{if } [v_L] = o \\ \{g_x : E\{y^2(n)\} = E\{x_{rd}^2(n)\}\} & \text{if } [v_L] = 1 \end{cases} \tag{13}$$

from which $g_x$ can be solved (note that E{.} stands for statistical/time averages). The gain parameter that controls the power of the signal created in the bandwidth extended spectral band ($f_{LO}^O$,$f_{HI}^O$) is chosen as:

$$g_w=\min(\mathfrak{o}_w^2(.),g_{w,max}) \tag{14}$$

where $\wp$ reads as "proportional to." Therefore, $g_w$ is upper bounded, and it is directly proportional to the estimated ambient noise power at the near-end.

Notwithstanding the foregoing, there may be instances or configurations into which signal processor 38 is placed where the corresponding near-end signal 9 is only sometimes, or perhaps even never, available for use in carrying out bandwidth extension. For these example scenarios when the corresponding near-end signal 9 is not available, the near-end ambient noise has no automatic bearing on the bandwidth extension gain control unit 32. Therefore, since $\sigma_w^2(.)$ cannot in these scenarios be calculated as described above, $g_w$ can instead be assigned to be a constant for purposes of carrying out bandwidth extension when the near-end-signal 9 is not available. The preferred value for such a constant is likely to depend highly upon the actual or contemplated circumstances of a given application of the present invention. As a result, any such constant is preferably selected with those circumstances in mind and with a view towards maximizing the intelligibility and perceived quality of the resultant bandwidth extended communication signal for the target listening audience.

Figure 8:
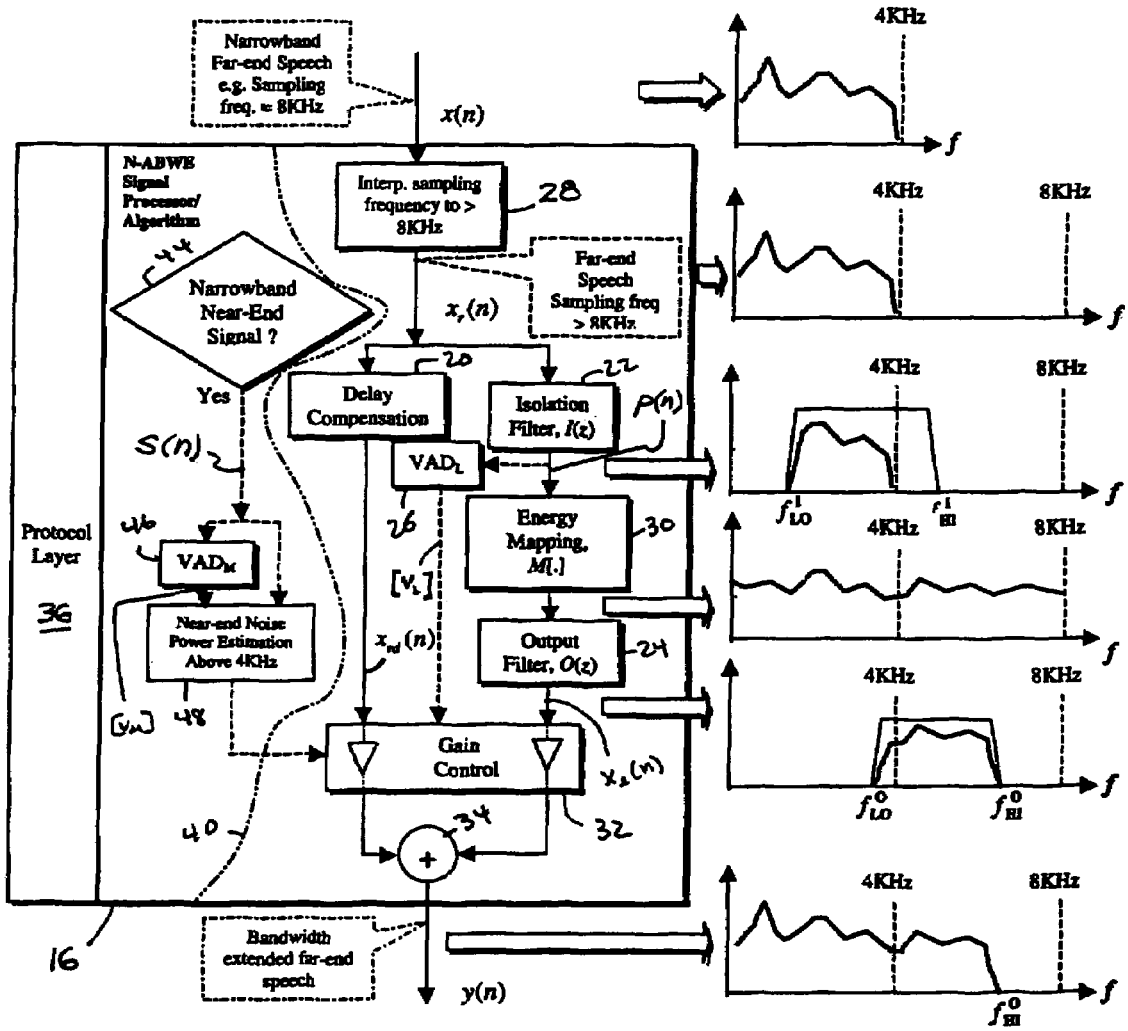
FIG. 8 is a more detailed block diagram and associated waveforms of an example network device signal processor embodiment for performing bandwidth extension, the associated network device using a protocol layer to negotiate a network connection to which bandwidth extension is applied, and such associated network device further having the capability of using a signal representing the near-end speech communication (including ambient noise) in generating the bandwidth extended communication signal.

The signal processor 16 illustrated in FIG. 8 operates similarly to that described above in connection with the signal processor block 38 illustrated in FIG. 7, except that in FIG. 8, a protocol layer 36 is further shown that can be used to negotiate a network connection to which bandwidth extension is applied.

Figure 9:
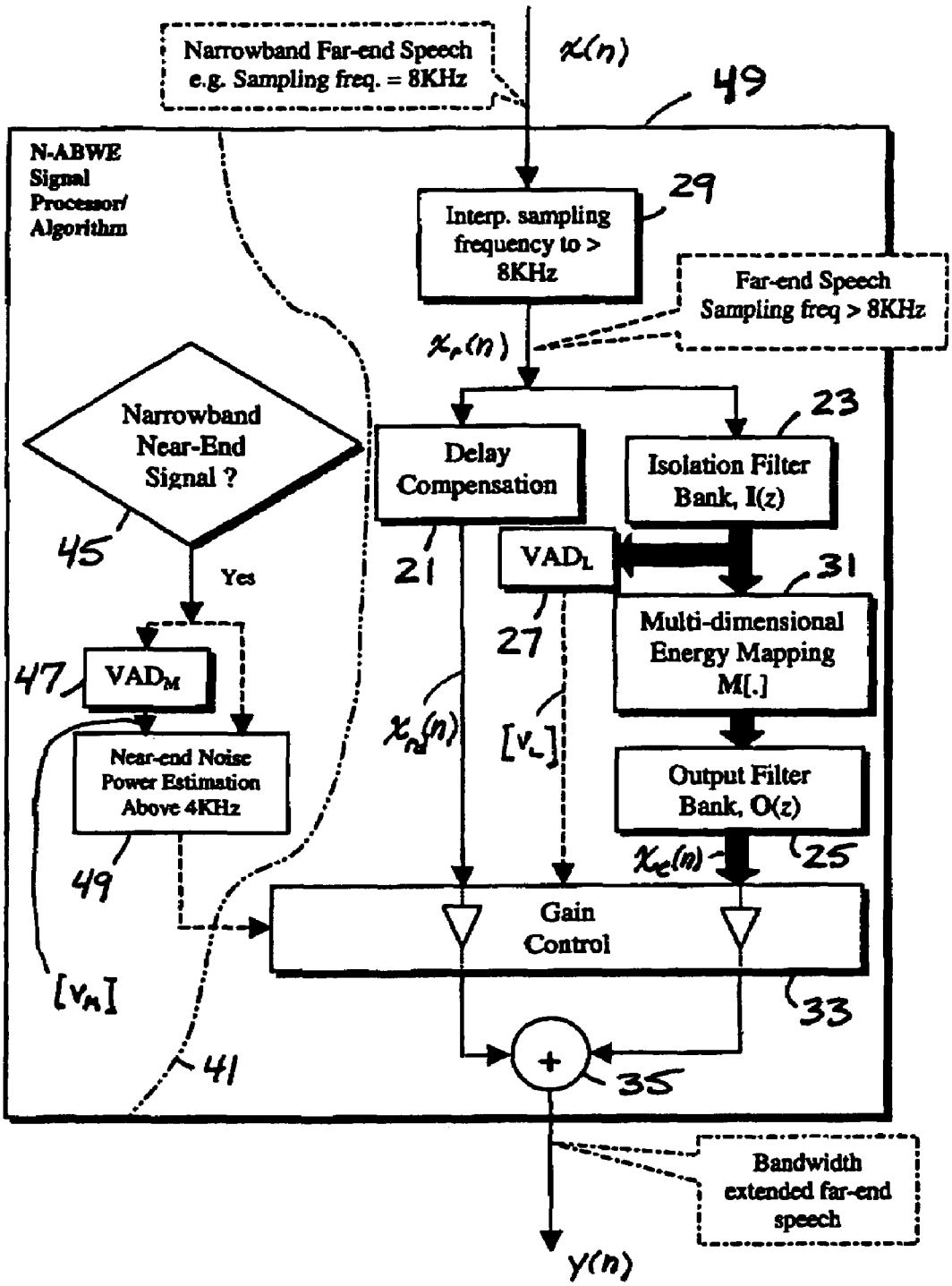
FIG. 9 is a block diagram of a generalized example signal processor and associated methodology for performing bandwidth extension in a network device that is capable of performing multi-dimensional bandwidth extension, such as for example a network device that is capable of processing more than one frequency band for the purpose of generating a bandwidth extended speech communication for a given far-end speech communication.

FIG. 9 schematically illustrates methods and apparatus associated with another example embodiment signal processor 49. Signal processor 49 is similar to the above described signal processor embodiment 38, although instead of passing only a single frequency band (such as, for example, that single band shown and described above as being bounded by $f_{LO}^I$ and $f_{HI}^I$ in the case of isolation filter 22, and that single band shown and described above as being bounded by $f_{LO}^O$ and $f^{HIO}$ for output filter 24), signal processor 49 by contrast is adapted to pass and process plural frequency bands for the purpose of generating a bandwidth extended speech communication for a given far-end speech communication, using filter banks 23 and 25 and multi-dimensional energy mapper 31. If the number of bands passed and processed by signal processor 49 for a given far-end speech communication equals B, for example, the output of the signal processor 49 can be written is the Z-domain as:

$$Y(z)=g_x X_{rd}(z)+G_w^T M[I(z)X_r(z)]O(Z) \tag{15}$$

where $$I(z)=\begin{bmatrix} I_o(z) & o & \dots & o \\ o & I_1(z) & \dots & o \\ \vdots & \vdots & \ddots & \vdots \\ o & o & \dots & I_{B-1}(z) \end{bmatrix} \tag{16}$$

is the isolation filter-bank 23, $$O(z)=[O_0(z)O_1(Z)\dots O_{B-1}(Z)]^T \tag{17}$$

is the output filter bank 25, $$M_{i,j}[I(z)X_T(z)]=\begin{cases} M[I(z)X_r(z)] & i=j \\ o & i\neq j \end{cases} \tag{18}$$

is the multi-dimensional energy mapper 31 function as the elements of a matrix, and $$G_w^T=[g_{w,0}\, g_{w,1}\dots g_{w,B-1}] \tag{19}$$

With respect to this multi-dimensional bandwidth extension example embodiment, $g_x$ can be derived in the same manner as described above with respect to equation (13). Also, those skilled in the art will understand from this disclosure of the present invention that the respective gains of $G_w$ each can be derived using the fundamental principles taught above in connection with equation (14).

The application of the present invention to network devices thus allows voice communications to be extended, thereby improving the perceived quality of the communication. Such extension can be carried out either with or without the benefit of near-end signals and, in those cases where a plurality of channels are supported by a multi-channel network device, the extension can be conducted concurrently on such plural channels.

Figure 10:
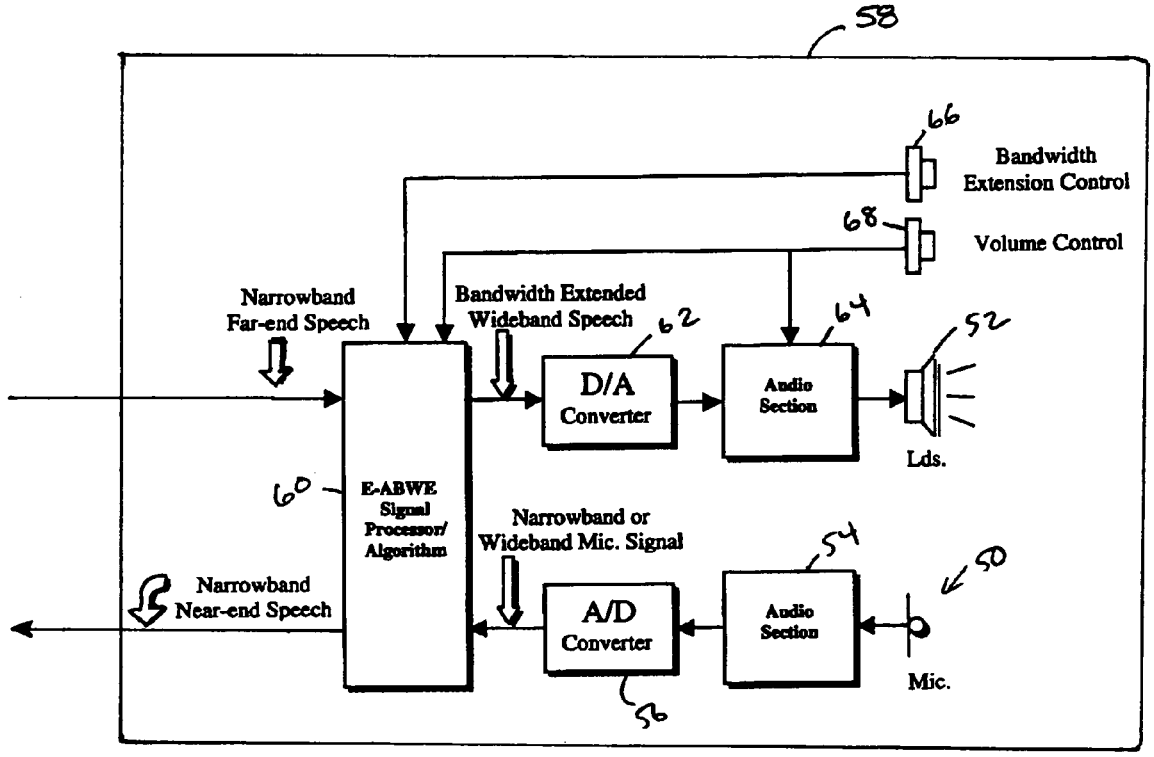
FIG. 10 is a block diagram of an example embodiment in which bandwidth extension is performed within an end-terminal device.

Referring now to end-terminal devices, and more particularly to FIG. 10 which illustrates an example end-terminal device embodiment of the present invention, an end-terminal device handset 58 is shown that includes a microphone 50, a loudspeaker 52, and circuitry including the circuitry represented by blocks 54, 56, 60, 62 and 64. In the case of where end-terminal device handset 58 is a telephone handset, the loudspeaker 52 and microphone 50 can be the same standard loudspeaker and microphone that are otherwise provided in a traditional telephone handset. Signals from microphone 50 are provided to an audio section 54 and an A/D converter 56 which then provides a narrowband or wideband microphone signal to signal processor 60, which then provides narrowband speech as an output to be transmitted through the communication network to a far-end device (not shown).

In the example embodiment of FIG. 10, the signal processor 60 bears the label that reads "E-ABWE," which means simply that the signal processor 60 is deployed so as to carry out a method of processing speech communications in an end-terminal device environment (E-) to provide artificial bandwidth extension (ABWE) within the scope of the present invention. In this example embodiment, instructions executed by signal processor 60 in accordance with the present invention may be supplied, for example, by firmware or other software. The "E-ABWE" label also appears in other of the figures, and has the same meaning with respect to such other figures.

For illustration purposes, for example, consider a case where a narrowband far-end speech is received as an input from the far-end device and provided to signal processor 60, which in turn provides wideband bandwidth extended speech in accordance with the present invention to a D/A converter 62, then to an audio section 64, and then to loudspeaker 52. Of course, the teachings set forth herein for end-terminal devices are not limited to only narrowband to wideband bandwidth extensions, but rather other alternative extensions can be similarly realized in accordance with the present invention.

As indicated by the example embodiment shown in FIG. 10, the user of the end-terminal device handset can make bandwidth extension control adjustments using bandwidth extension control input 66, and can also make volume control adjustments using volume control input 68, although either or both of these controls is optional. The bandwidth extension control input 66 allows the end-user to provide added control over the extent to which the signal representing the extension portion of the speech communication, $x_e(n)$, is amplified relative to the far-end speech communication in its non-extended form, $x_{rd}(n)$. The volume control input 68 allows the end-user to provide added control over the overall volume level of the complete bandwidth extended communication signal, y(n). Currently, many of the latest telephone handset designs already have a volume control, and thus the further use of such a volume control for the purposes described herein can be readily accomplished.

Figure 11:
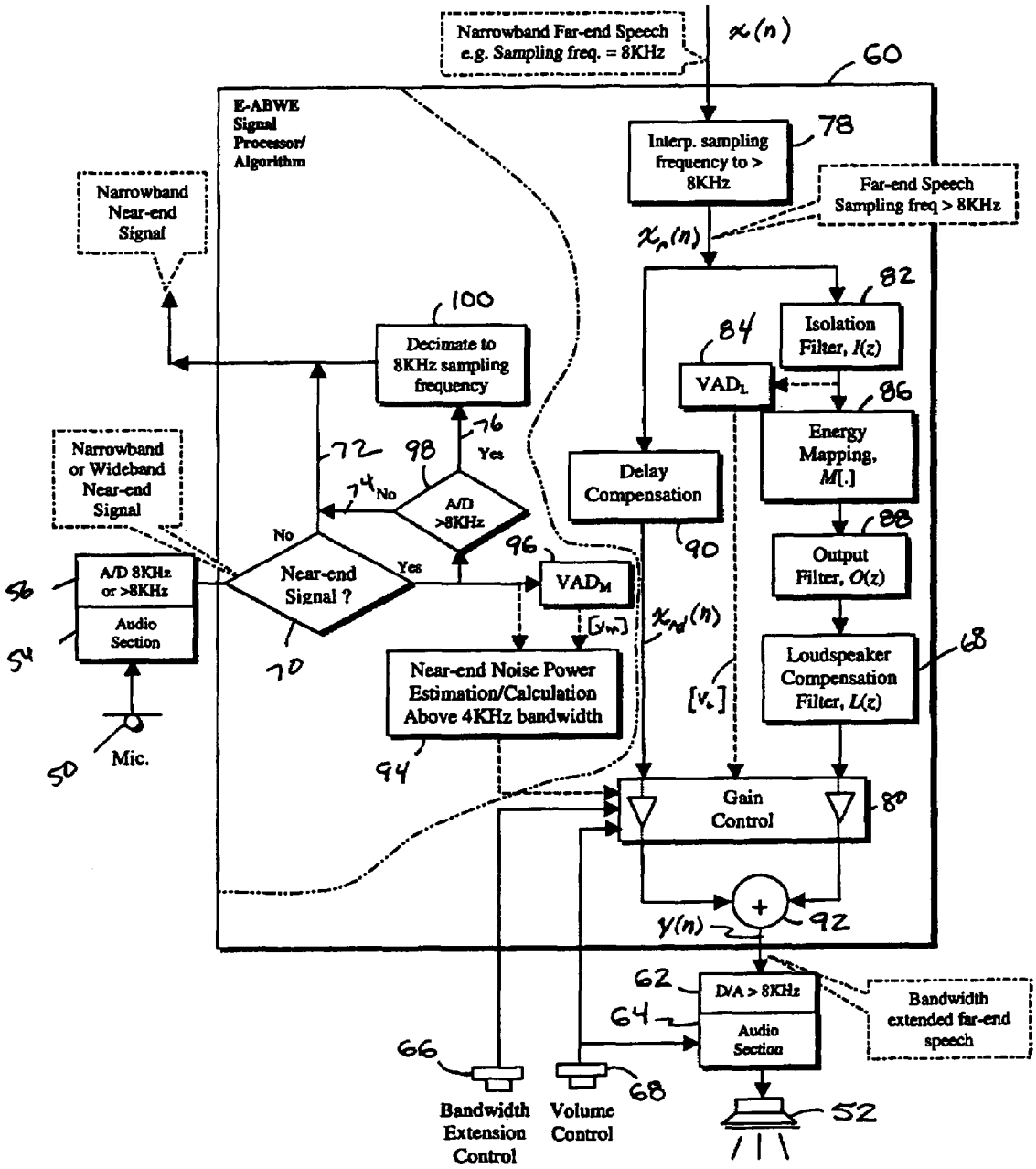
FIG. 11 is a more detailed block diagram and associated waveforms of an example end-terminal device embodiment for performing bandwidth extension.

Referring now to FIG. 11, which is set forth to illustrate the processing executed by signal processor 60, the filtering blocks 82 and 88, delay compensation block 90, voice detector $VAD_L$ 84, sampling block 78 and energy mapping block 86, are each essentially the same in function to their corresponding block(s) (22, 24, 20, 26, 28 and 30, respectively) described above in the context of signal processor 38 and FIG. 7. Also, the decision block 70, $VAD_M$ 96, and noise power block 94 of FIG. 11 are each substantially similar in function to their corresponding block (44, 46 and 48, respectively) described above in the context of FIG. 7. As a result, those skilled in the art will understand from the totality of this disclosure that many of the signal flows, graphs, methods and apparatus described above in the network device embodiment context (see, e.g., disclosure associated with FIGS. 6 and 7) each are, generally speaking, similarly applicable in the end-terminal device embodiment context, and thus the details of such are incorporated by reference in this end-terminal device embodiment description but not repeated here for purposes of clarity and conciseness.

The end-terminal device embodiment 58 to which the signal processor 60 of FIG. 11 relates has certain significant additional features (as compared to the network device embodiment of FIG. 7, for example) including bandwidth extension control 66 and volume control 68, each of which can further influence the gain control block 80, as is shown in FIG. 11. Signal processor 60 also includes loudspeaker compensation filter 68, as well as additional local ambient noise processing methods and apparatus represented by blocks 98 and 100.

The frequency response of a given loudspeaker transducer 52 in an end-terminal device handset 58, such as a telephone handset for example, will generally be known to the handset manufacturer. To compensate for this frequency response, a loudspeaker compensation filter 68, L(z), is provided. L(z) is a stable filter 68, with impulse response i(n), and is chosen according to $$\left|\frac{\partial|L(e^{j\theta})L_{TD}(e^{j\theta})|}{\partial\theta}\right|_{\theta\in[-\pi,\pi]} < \delta \tag{20}$$

to approximately equalize the loudspeaker response.

The processing on the microphone 50 (near-end) side can differ from the network device embodiments described above. More specifically, there are three alternatives with reference to block 70 in FIG. 11:

i) The microphone side signal is not available to processor 60, as such negative response is represented by decision line 72. In this case, the ambient noise power gain, $g_w$, is chosen as a constant.

ii) The microphone side signal is available, but is sampled at or below the sampling frequency that is ordinarily associated with the input far-end speech signal (which, by way of example, has been previously described herein as being a 8 KHz sampling frequency for a far-end speech signal having 4 KHz of bandwidth) as shown at decision line 74. Similar to the network device case, the ambient noise power is estimated by using a method similar to equations (9) or (10).

iii) The microphone side signal is available and it is sampled faster than 8 KHz as shown at decision line 76. This circumstance, at least in the context of a narrowband (4 KHz) to wideband (8 KHz) bandwidth extension of the sort described in the above example, thus provides actual near-end ambient noise power information for at least a portion of frequency spectrum that corresponds to the extension portion of the speech communication, $x_e(n)$. In this case, the ambient noise power in the bandwidth extension portion of the frequency spectrum, as determined using the microphone side signal, is directly calculated instead of using an estimate.

A filter which has the same spectral response as the output filter, o(n), on the loudspeaker side is preferably also employed. Ambient noise power required for gain control block 80 is computed as $$\sigma_w^2(n)=\lambda\sigma_w^2(n-1)+(1-\lambda)\breve{s}^2(n) \tag{21}$$

or $$\breve{\sigma}_w^2(k) = \frac{1}{R}\sum_{j=o}^{R-1}\breve{s}^2(Rk+j) \tag{22}$$

when $[v_M]=1$, where s(n)=s(n)*o(n).

The output of processor 60 thus is:

$$y(n)=g_x x_{rd}(n)+g_w M[x_r(n)*i(n)]*o(n)*l(n) \tag{23}$$

The control of the gain parameters is different depending on whether the processor 60 can get (1) no explicit information on the volume control 68 settings of the end-terminal device 58, (2) information of the volume control 68 setting of the end-terminal device 58, (3) a user-controlled manual bandwidth extension control 66 that controls the power of the extended signal y(n), and (4) user volume control 68 information as well as a manual bandwidth extension control 66 from the user.

Case 1 (no volume or bandwidth control):

$$g_x = \begin{cases} 1 & \text{if } [\upsilon_L] = o \\ \{g_x : E\{y^2(n)\} = E\{x_{rd}^2(n)\}\} & \text{if } [\upsilon_L] = 1 \end{cases} \tag{24}$$

and $$g_w=\min(\wp\sigma_w^2(.),g_{w,max}) \tag{25}$$

Case 2 (volume control):

$$g_x = \begin{cases} 1 & \text{if } [\upsilon_L] = o \\ \{g_x : E\{y^2(n)\} = \Xi_V\} & \text{if } [\upsilon_L] = 1 \end{cases} \tag{26}$$

with $\Xi_V$ is the volume setting adjusted by the user and $$g_w=\max(\wp\sigma_w^2(.),g_{w,max}) \tag{27}$$

where $\sigma_w^2(.)$ is defined as in (30), (31) with š(n)=s(n)*o(n)

Case 3 (bandwidth control):

$$g_x = \begin{cases} 1 & \text{if } [\upsilon_L] = o \\ \{g_x : E\{y^2(n)\} = E\{x_{rd}^2(n)\}\} & \text{if } [\upsilon_L] = 1 \end{cases} \quad (28)$$

and $$g_w = \min(\wp\sigma_w^2(.), \wp_B g_{w,max}) \quad (29)$$

where $g_w$ is again upper bounded by $g_{w,max}$. Furthermore, as well as being directly proportional to the ambient noise power, $g_w$ is also directly proportional to user setting defined as $\Xi_B$.

Case 4 (both volume control and bandwidth extension control):

$$g_x = \begin{cases} 1 & \text{if } [\upsilon_L] = o \\ \{g_x : E\{y^2(n)\} = \Xi_V\} & \text{if } [\upsilon_L] = 1 \end{cases} \quad (30)$$

and $$g_w = \max(\wp\sigma_w^2(.), \wp\Xi_B g_{w,max}) \quad (31)$$

Figure 12:
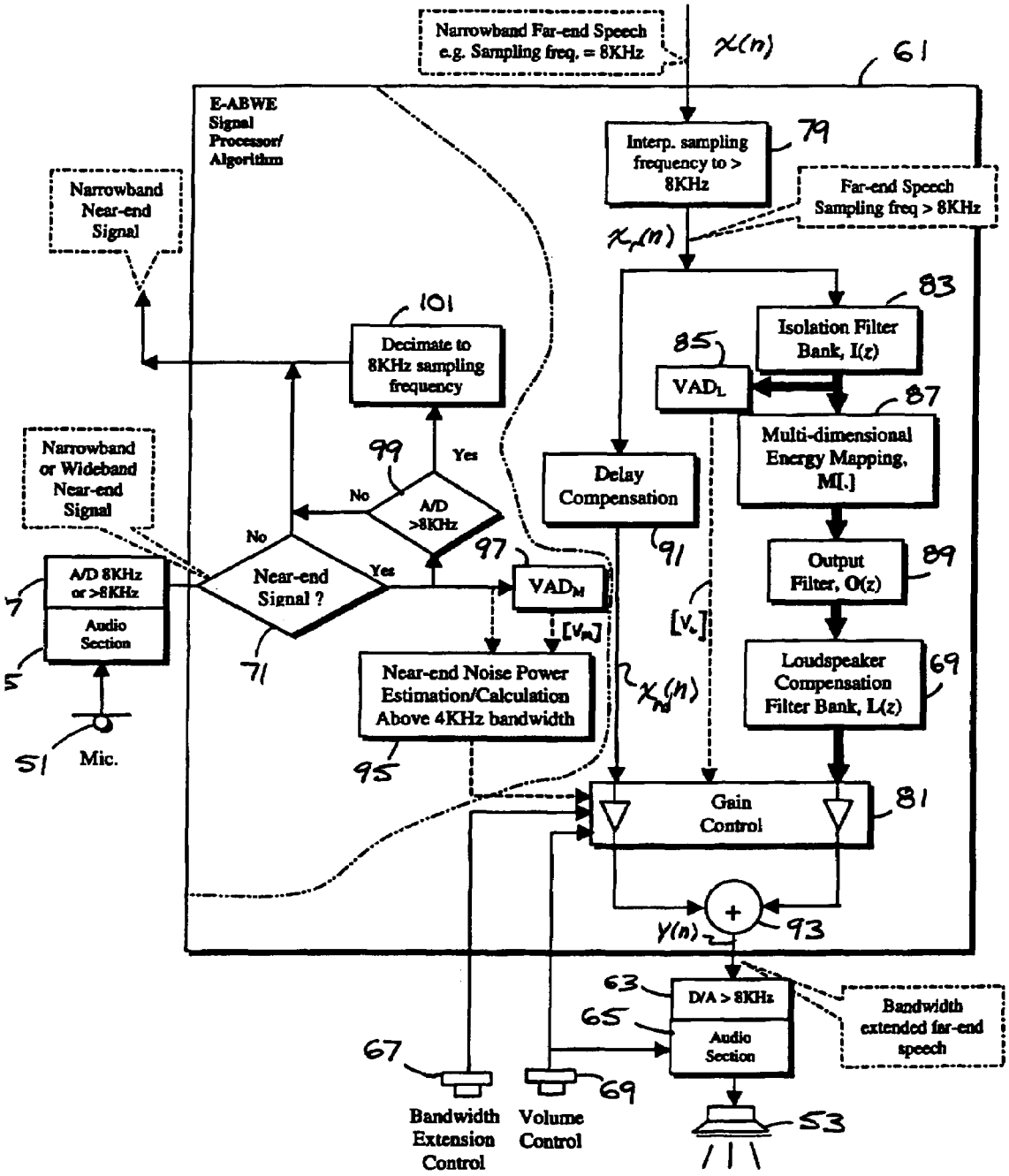
FIG. 12 is a block diagram of a generalized example processor and associated methodology for performing bandwidth extension in an end-terminal device that is capable of performing multi-dimensional bandwidth extension, such as for example an end-terminal device that is capable of processing more than one frequency band for the purpose of generating a bandwidth extended speech communication for a given far-end speech communication.

FIG. 12 schematically illustrates methods and apparatus associated with another example embodiment signal processor 61. Signal processor 61 is similar to the above described signal processor embodiment 60, although instead of using only a single pass band to filter derivatives of x(n), signal processor 61 by contrast is adapted to pass and process plural frequency bands for a given far-end speech communication, using filter banks 83, 89 and 69, and multi-dimensional energy mapper 87. If the number of bands passed and processed by signal processor 61 for a given far-end speech communication equals B, for example, the output of the signal processor 61 can be written is the Z-domain as:

$$Y(z) = g_x X_{rd}(z) + G_w^T M[I(z) X_r(z)] L(z) O(z) \quad (32)$$

where $$L(z) = \begin{bmatrix} L_o(z) & o & \dots & o \\ o & L_1(z) & \dots & o \\ \vdots & \vdots & \ddots & \vdots \\ o & o & \dots & L_{B-1}(z) \end{bmatrix} \quad (33)$$

is loudspeaker compensation filter bank 69. With respect to this multi-dimensional bandwidth extension example embodiment, $g_x$ can be derived in the same manner as described above with respect to equations (24), (26), (28) and (30). Also, those skilled in the art will understand from this disclosure of the present invention that the respective gains of $G_w$ each can be derived using the fundamental principles taught above in connection with equations (25), (27), (29) and (31).

Independent of the issue of extending the bandwidth of speech communications that are confined to a relatively narrow spectral region due to equipment limitations or otherwise, speech signals on a communications network may be or become degraded such that one or more isolated parts of the supported frequency spectrum are missing, lost or degraded with unwanted artifacts. This can occur not only in speech communications that may be constrained to a rather narrow band-limited region, but further can occur in the context of speech communications that may be already supported by even a broader spectral range such as, for example, wideband and broadband speech communications. The methods and apparatus of this aspect of the present invention can find application in any and all of the foregoing situations to help improve the perceived quality of the communicated speech signal for an enhanced user experience.

Figure 14:
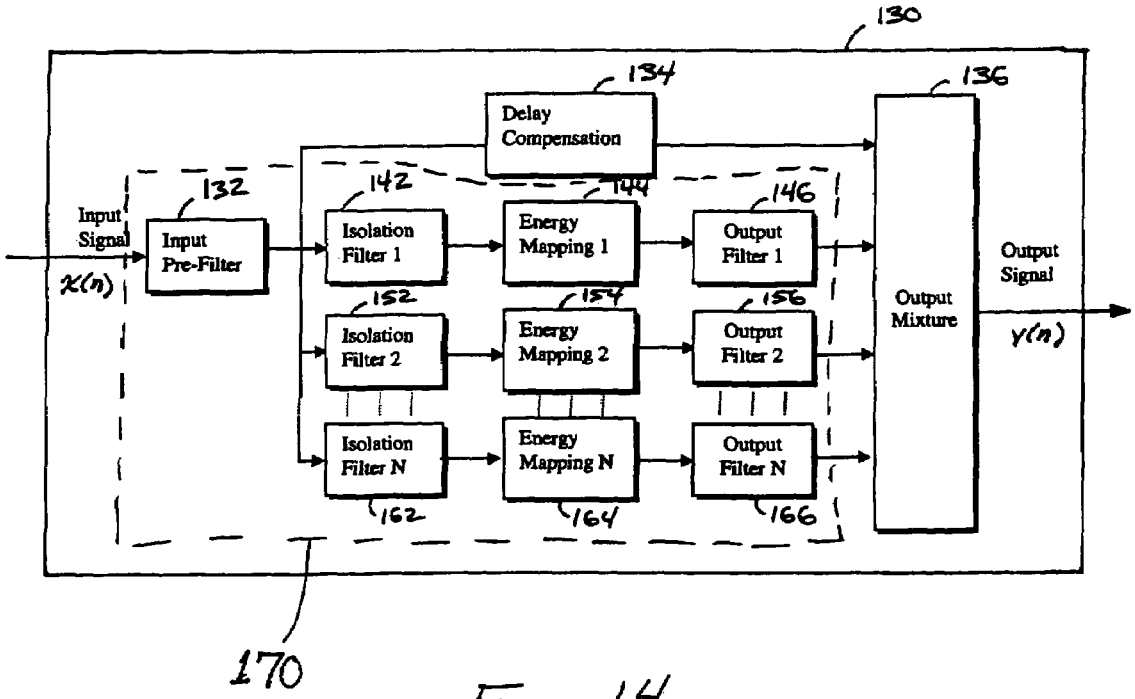
FIG. 14 shows a schematic block diagram of another example embodiment of a device that employs bandwidth extension in accordance with the present invention to, for example, help improve or enhance the perceived quality of a speech communication that is degraded or otherwise lacking in quality.

FIG. 14 sets forth a schematic illustration showing another example embodiment of the present invention. One of ordinary skill in the art will understand, in view of the foregoing description and illustrations, that this embodiment shown in FIG. 14 could be configured to provide spectral expansion bandwidth extension similar to that which has been described above in the context of the foregoing example embodiments. However, in order to further describe and illustrate another aspect of the present invention, namely spectral enhancement bandwidth extension, the example embodiment of FIG. 14 is described below to improve the quality of the far-end speech signal by extending the far-end speech communication to include one or more artificially created points within the region defined by the lowest limit and highest limit of the frequency spectrum by which such far-end speech communication is characterized. While the various embodiments disclosed herein have been described as performing either spectral expansion or spectral enhancement bandwidth extension, it is important to note that it is also within the scope of the present invention for a given device to perform both spectral expansion and spectral enhancement bandwidth extension on a given far-end speech communication.

Device 130 illustrated in FIG. 14 can be viewed generally to represent either a network device or end-terminal device. The first processing applied in this example embodiment at input pre-filter 132 is to remove from the far-end speech communication signal, x(n), any portion(s) of the input spectrum which are to be substituted with new spectrum generated from the spectral enhancement bandwidth extension techniques of the present invention. These removed portions of the input spectrum may be localized portions of the far-end speech communication which are adversely affecting the quality of the speech communication, because for example such input spectrum portions may be degraded, or contain unwanted artifacts, or otherwise are lacking in quality. Once such portion(s) of the input spectrum are removed using input pre-filter 132, the resultant pre-filtered signal output from pre-filter 132 is provided in parallel to delay compensator 134 and to the other bandwidth extension components described in greater detail below.

More specifically, since the example embodiment shown in FIG. 14 is adapted to process up to two or more frequency bands for the purpose of generating a multi-dimensional bandwidth extended version of a given far-end speech communication, x'(n) is provided to up to two or more isolation filters (the number of filters depending upon the number of bands desired for processing purposes). Thus, isolation filters 142, 152 and 162, and any other intervening isolation filters numbered 3 through N−1, may together constitute an isolation filter bank similar in overall operation to the above-described isolation filter banks 23 and 83 in the multi-dimensional bandwidth extension embodiments shown and described above in connection with FIGS. 9 and 12, respectively. In FIG. 14, the respective frequency band that each respective isolation filter is configured to pass as an isolation filtered signal preferably does not overlap with any of the spectral portions that are removed by input pre-filter 132.

Following the isolation filters, the energy mappers 144, 154 and 164 (and any other corresponding intervening energy mappers numbered 3 through N−1), each operate to spectrally spread the energy received from the corresponding isolation filter beyond what is spectrally permitted to pass through the isolation filter. Thus, energy mappers 144, 154 and 164, and any other intervening mappers numbered up to N−1, each deliver an energy mapped output signal. Such energy mappers may together constitute a multi-dimensional energy mapper that is similar in overall operation to the above-described multi-dimensional energy mappers 31 and 87 in the multi-dimensional bandwidth extension embodiments shown and described above in connection with FIGS. 9 and 12, respectively.

Following the energy mapping step, the output filters 146, 156 and 166 are each adapted so as to pass (i.e., select) that portion of the energy mapper output which lies within a given frequency spectrum range that includes, at least in part, one or more spectral regions that correspond to portion(s) of the input spectrum which were removed by input pre-filter 132. Thus, output filters 146, 156 and 166, and any other intervening output filters numbered up to N−1, may together constitute an output filter bank that is similar in overall operation to the above-described output filter banks 25 and 89 in the multi-dimensional bandwidth extension embodiments shown and described above in connection with FIGS. 9 and 12, respectively.

Finally, output mixer 136 operates to receive the delayed pre-filtered signal output from delay compensator 134, which such signal represents the speech communication in its non-extended form. Output mixer 136 also operates to receive the various bandwidth extension component signals output by output filter blocks 146, 156 and 166, which such signals collectively represent the extension portion of the speech communication. Output mixer 136 then operates to, in a manner that is similar to the operation of the gain controllers 33 and 81 described above for the alternative embodiments shown in FIGS. 9 and 12, respectively, adjusts, sets or otherwise determines the power of the extension portion of the speech communication to an appropriate power level so that it is not powered too high or too low relative to the delayed speech communication in its non-extended form, but rather properly complements the speech communication in its non-extended form so as to preferably maximize the perceived quality of the resultant bandwidth extended communication signal. Output mixer 136 also operates to, again in a manner that is similar to the operation of the summers 35 and 93 described above for the alternative embodiments shown in FIGS. 9 and 12, respectively, operates to combine the signals so as to produce as an output a complete bandwidth extended communication signal, y(n).

In addition, other features described above in connection with other embodiments of the present invention find similar applicability to the example embodiment shown in FIG. 14. Thus, in this way, another embodiment of the present invention includes the embodiment which is created with reference to FIG. 9 by, for example, replacing isolation filter bank 23, multi-dimensional energy mapper 31 and output filter 25 of FIG. 9 with the component arrangement shown within reference box 170 in FIG. 14. Similarly, yet another embodiment of the present invention includes the embodiment which is created with reference to FIG. 12 by, for example, replacing isolation filter bank 83, multi-dimensional energy mapper 87 and output filter 89 of FIG. 12 with the component arrangement shown within reference box 170 in FIG. 14. Similar substitutions can also be made in FIGS. 6, 7, 8 and 11 to create additional uni-dimentional embodiments of the present invention, although in this context the replacement components from reference box 170 preferably includes a pre-filter followed consecutively in series by only one isolation filter 142, one energy mapper 144 and one output filter 146 as shown in FIG. 14, without including the additional multi-dimensional filter and energy mapping components illustrated in FIG. 14. Multi-channel embodiments, similar to that shown for example in FIG. 5, also could be realized based upon the disclosure herein.

In each of the above-described embodiments, the spectral characteristics for the various filters and energy mappers, as well as the power characteristics for the various gain controllers and output mixer, can be static, or alternatively could be dynamically provisioned using software-controlled processors, for example. Those of ordinary skill in the art will understand from the foregoing disclosure that the selection of applicable frequency and other characteristics for the filters, energy mapper(s) and gain controller in each embodiment described above necessarily depends upon, for example, whether the objective of the bandwidth extension is spectral expansion, spectral enhancement, or both, and how the input speech communication otherwise differs, both spectrally and otherwise, from the desired bandwidth extended speech communication.

Those of ordinary skill in the art will also understand from the description and illustrations herein that it is within the scope of the present invention and disclosure to iteratively add additional bandwidth extension components (in parallel, for example) to those components set forth in the example embodiments described above so as to simultaneously generate more than one extension portion for a given input speech communication, regardless of whether the objective is bandwidth extension for spectral expansion, spectral enhancement, or both, and regardless of whether such bandwidth extension is accomplished using uni-dimensional or multi-dimensional techniques as described above. Such techniques may be important, for example, with respect to those input speech communications each having a plurality of missing, degraded or otherwise compromised spectral components at varying points along the associated frequency spectrum.

The above description details various other objects and advantages of the present invention, with reference to numerous example embodiments. Although certain embodiments of the invention have been described and illustrated herein, it will be apparent to those of ordinary skill in the art that a number of omissions, modifications and substitutions can be made to the example methods and apparatus disclosed and described herein without departing from the true spirit and scope of the invention.

Various features of the present invention can be realized or implemented in hardware, software, or a combination of hardware and software. By way of example only, some aspects of the subject matter described herein may be implemented in computer programs executing on programmable computers or otherwise with the assistance of microprocessor functionalities. In general, at least some computer programs may be implemented in a high level procedural or object-oriented programming language to communicate with a computer system. Furthermore, some programs may be stored on a storage medium, such as for example read-only-memory (ROM) readable by a general or special purpose programmable computer, for configuring and operating the computer or machine when the storage medium is read by the computer or machine to perform the provided functionality.

In addition, while certain features have been described as advantageous, a device may be covered by the claims indicated below and yet not have every one of these advantages;

moreover, while certain drawbacks may have been identified herein in typical prior art systems, a system may fall within the scope below and yet still have some drawback of other systems but improvements in other aspects. In other words, by identifying certain shortcomings of certain prior art systems, it is not intended to be a disclaimer of any system that has any of those drawbacks of disadvantages.

I claim:

1. An end-terminal device bandwidth extension system comprising:

bandwidth extension circuitry for receiving a signal with frequency ≦4 KHz and providing an output signal including a signal with a narrowband component ≦4 KHz and an extended component >4 KHz;

gain control for controlling power of the extended signal relative to power of the narrowband signal; and a loudspeaker coupled to the gain control for outputting the output signal.

2. The end-terminal device bandwidth extension system of claim 1, further comprising a microphone and a detector for determining ambient noise from the microphone and for providing a signal to the gain control in response to the detection.

3. The end-terminal device bandwidth extension system of claim 1, further comprising a first voice activity detector that detects the signal and mutes application of the bandwidth extension circuitry during pauses between speech signals in order to not extend spectrum of additive background noise.

4. The end-terminal device bandwidth extension system of claim 3, further comprising a second voice activity detector operating on the input signal and sampled faster than 8 KHz is used to compute an ambient noise power in the bandwidth extended spectral range.

5. The end-terminal device bandwidth extension system of claim 1, wherein ambient noise power is measured on the input signal to control a gain of the extended signal.

6. The end-terminal device bandwidth extension system of claim 1, further comprising a user volume control to control information used in the output gain control.

7. The end-terminal device bandwidth extension system of claim 1, further comprising a user control over a gain of the generated signal in the extended signal relative to the narrowband signal.

8. The end-terminal device bandwidth extension system of claim 1, wherein the input signal is up-sampled at a higher sampling frequency by using an interpolation mechanism.

9. The end-terminal device bandwidth extension system of claim 1, wherein the input signal is delay compensated before applying to the gain control.

10. The end-terminal device bandwidth extension system of claim 1, wherein the bandwidth extension circuitry includes an isolation filter for capturing a part of the spectrum in the 0-4 KHz range.

11. The end-terminal device bandwidth extension system of claim 10, further comprising an energy mapping function implemented as a non-linear function and applied to a signal output from the isolation filter.

12. The end-terminal device bandwidth extension system of claim 11, further comprising an output filter for capturing a part of a signal output from the energy mapping function in the extended frequency range.

13. The end-terminal device bandwidth extension system of claim 1, further comprising a loudspeaker compensation filter for approximately equalizing a loudspeaker frequency response.

14. The end-terminal device bandwidth extension system of claim 1, wherein the gain control combines the input signal and the extended signal so that the output energy is the same as the energy of the input signal.

15. The end-terminal device bandwidth extension system of claim 1, wherein the gain control combines the input signal and the extended signal so that the output energy is equal to a level set by a user of the end-terminal device.

16. The end-terminal device bandwidth extension system of claim 12, wherein the isolation filtering, the energy mapping, output filtering and loudspeaker compensation filtering are generalized to work in multiple frequency bands.

17. A method of providing for bandwidth extension, comprising:

up-sampling a digital input signal with frequency ≦4 KHz with an increased frequency relative to a sampling rate of the digital input signal to produce an extended signal component >4 KHz;

providing an output signal including a signal with a narrowband signal component ≦4 KHz and the extended signal component >4 KHz; and controlling gain to control power of the extended signal component relative to power of the narrowband signal component of the output signal; and outputting the output signal.

18. The method of claim 17 further including detecting an ambient noise power in the extended signal component and providing a logical signal to enable gain control of the output signal.

19. The method of claim 17 further including detecting a first voice activity based on detecting speech signals and disabling up-sampling during pauses between speech signals to prevent extending a spectrum of an additive background noise in the input signal.

20. The method of claim 19 further including detecting a second voice activity based on up-sampling the input signal faster than 8 KHz to compute power of the additive background noise in a bandwidth extended spectral range.

21. The method of claim 17 further including measuring ambient noise power on the input signal to control the power of the extended signal component.

22. The method of claim 17 further including controlling a level of amplification of the extended signal component relative to the input signal component.

23. The method of claim 17 further including up-sampling the input signal at an increased frequency by interpolating the input signal using an interpolation mechanism.

24. The method of claim 17 further including combining the input signal and the extended signal component in a manner producing an output signal having energy about the same as the energy of the input signal.

25. The method of claim 17 further including combining the input signal and the extended signal component in a manner producing an output signal having energy about equal to a level set by a user.

* * * * *